US010640943B2

(12) United States Patent
Marsolek et al.

(10) Patent No.: US 10,640,943 B2
(45) Date of Patent: May 5, 2020

(54) SYSTEM AND METHOD FOR COMPACTING A WORKSITE SURFACE

(71) Applicant: Caterpillar Paving Products Inc., Brooklyn Park, MN (US)

(72) Inventors: John L. Marsolek, Watertown, MN (US); Jacob J. McAlpine, Otsego, MN (US); Robert J. McGee, Peoria, IL (US); Timothy M. O'Donnell, Long Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 133 days.

(21) Appl. No.: 15/841,771

(22) Filed: Dec. 14, 2017

(65) Prior Publication Data

US 2019/0186094 A1 Jun. 20, 2019

(51) Int. Cl.
*E02D 3/046* (2006.01)

(52) U.S. Cl.
CPC ..... *E02D 3/046* (2013.01); *E02D 2600/10* (2013.01)

(58) Field of Classification Search
CPC ..... E02D 3/046; E01C 19/288; E01C 19/002; E01C 19/488; E01C 23/01; E01C 2301/20
See application file for complete search history.

(56) References Cited

U.S. PATENT DOCUMENTS 5,471,391 A 11/1995 Gudat et al.
6,085,130 A * 7/2000 Brandt ..... G05D 1/0278 701/26
6,088,644 A * 7/2000 Brandt ..... E01C 19/004 172/4.5
6,112,143 A * 8/2000 Allen ..... E01C 19/006 342/357.32
6,128,574 A 10/2000 Diekhans
6,750,621 B2 6/2004 Gandrud
7,491,014 B2 * 2/2009 Sick ..... E01C 19/004 404/133.05
7,623,951 B2 11/2009 Congdon et al.
7,731,450 B2 * 6/2010 Congdon ..... E01C 19/288 404/84.5
7,873,492 B2 1/2011 Ackermann
9,511,633 B2 12/2016 Anderson et al.
9,982,397 B2 * 5/2018 Korb ..... E02D 3/02
(Continued)

FOREIGN PATENT DOCUMENTS

WO 2008049542 5/2008

*Primary Examiner* — Abigail A Risic
(74) *Attorney, Agent, or Firm* — Lee & Hayes, PLLC

(57) ABSTRACT

A method includes receiving first information indicative of a location of a perimeter of a worksite surface, and receiving second information indicative of compaction requirements specific to the worksite surface. The method also includes generating a compaction plan based at least partly on the first and second information. Such a compaction plan includes a travel path for a compaction machine. In such a method, the travel path is substantially within the perimeter of the worksite surface. The method also includes causing at least part of the travel path to be displayed via a control interface of the compaction machine. The method further includes receiving an input indicative of approval of the travel path, and controlling operation of the compaction machine on the worksite surface, in accordance with the compaction plan, based at least partly on receiving the input.

20 Claims, 10 Drawing Sheets

(56) References Cited

U.S. PATENT DOCUMENTS

| | | | | |
|---|---|---|---|---|
| 2007/0025815 | A1* | 2/2007 | Sick | E01C 19/004 404/84.1 |
| 2007/0239338 | A1* | 10/2007 | Potts | E01C 19/288 701/50 |
| 2008/0063473 | A1* | 3/2008 | Congdon | E01C 19/288 404/75 |
| 2009/0142133 | A1* | 6/2009 | Glee | E01C 19/004 404/75 |
| 2010/0087992 | A1* | 4/2010 | Glee | E01C 19/288 701/50 |
| 2012/0107045 | A1* | 5/2012 | DeClerk | E01C 19/236 404/75 |
| 2015/0167257 | A1* | 6/2015 | Korb | E02D 3/02 404/76 |
| 2016/0103051 | A1* | 4/2016 | Corcoran | G01N 9/36 404/75 |
| 2016/0222602 | A1* | 8/2016 | Downing | E01C 19/004 |

* cited by examiner

SYSTEM AND METHOD FOR COMPACTING A WORKSITE SURFACE

TECHNICAL FIELD

The present disclosure relates to a control system for a compaction machine. More specifically, the present disclosure relates to a control system configured to generate a compaction plan for a compaction machine based on worksite surface information and compaction requirements.

BACKGROUND

Compaction machines are frequently employed for compacting soil, gravel, fresh laid asphalt, and other compactable materials associated with worksite surfaces. For example, during construction of roadways, highways, parking lots and the like, one or more compaction machines may be utilized to compact soil, stone, and/or recently laid asphalt. Such compaction machines, which may be self-propelling machines, travel over the worksite surface whereby the weight of the compaction machine compresses the surface materials to a solidified mass. In some examples, loose asphalt may then be deposited and spread over the worksite surface, and one or more additional compaction machines may travel over the loose asphalt to produce a densified, rigid asphalt mat. The rigid, compacted asphalt may have the strength to accommodate significant vehicular traffic and, in addition, may provide a smooth, contoured surface capable of directing rain and other precipitation from the compacted surface.

Traditional approaches to compacting soil, stone, and other materials associated with the worksite surface rely upon operator judgment and perception, and such approaches require substantial operator training and preparation time. These approaches have the potential for human error and tend to result in compacted worksite surfaces that are inconsistent in quality. For example, even with significant training, it can be difficult for operators to adhere to density specifications and/or other compaction requirements associated with a particular worksite surface. Additionally, it is commonplace for operators to over-compact portions of the worksite surface by compacting such portions more than necessary. Accordingly, when constructing, for example, long roads, highways, large parking lots, and the like, a significant number of deficiencies typically appear. These deficiencies tend to reduce the integrity of such structures, and can result in premature cracking or other unwanted conditions.

One method of improving traditional approaches to compacting a worksite surface is described in U.S. Pat. No. 6,750,621 (hereinafter referred to as "the '621 reference"). The '621 reference describes a compaction machine having two drums with variable vibratory mechanisms. Sensors are used to collect certain vibratory characteristics from each drum, and a control unit associated with the compaction machine may adjust the compaction effort of the drum to a selected setting. The control unit also calculates the difference between the measured vibratory characteristics on both the front and rear drums, and uses this information to assist in the compaction process. The system described by the '621 reference does not, however, assist the operator in determining the most efficient travel path for compacting the worksite surface such that over-compaction of the worksite surface can be avoided. Nor does the system described by the '621 reference automatically control the amplitude and/or frequency of vibration during the compaction process in order to satisfy compaction requirements specific to the particular worksite surface being acted upon.

Example embodiments of the present disclosure are directed toward overcoming the deficiencies of such systems.

SUMMARY

In an aspect of the present disclosure, a method includes receiving first information indicative of a location of a perimeter of a worksite surface, and receiving second information indicative of compaction requirements specific to the worksite surface. The method also includes generating a compaction plan based at least partly on the first and second information, the compaction plan including a travel path for a compaction machine. In such an example, the travel path is substantially within the perimeter of the worksite surface. The method also includes causing at least part of the travel path to be displayed via a control interface of the compaction machine. The method further includes receiving an input indicative of approval of the travel path, and controlling operation of the compaction machine on the worksite surface, in accordance with the compaction plan, based at least partly on receiving the input.

In another aspect of the present disclosure, a control system includes a location sensor configured to determine a location of a compaction machine on a worksite surface, a control interface connected to the compaction machine, and a controller in communication with the location sensor and the control interface. In such an example, the controller is configured to receive first information indicative of a location of a perimeter of the worksite surface, and receive second information indicative of compaction requirements specific to the worksite surface. The controller is also configured to generate a compaction plan based at least partly on the first and second information, the compaction plan including a travel path for the compaction machine. In such an example, the travel path is substantially within the perimeter of the worksite surface. The controller is also configured to control operation of the compaction machine on the worksite surface, in accordance with the compaction plan, based at least partly on receiving an input indicative of approval of the travel path.

In yet another aspect of the present disclosure, a compaction machine includes a substantially cylindrical drum configured to compact a worksite surface as the compaction machine traverses the worksite surface, a location sensor configured to determine a location of the compaction machine on the worksite surface, a control interface, and a controller in communication with the location sensor and the control interface. In such an example, the controller is configured to receive first information from the location sensor indicative of a location of a perimeter of the worksite surface, and receive second information indicative of compaction requirements specific to the worksite surface. The controller is also configured to generate a compaction plan based at least partly on the first and second information, the compaction plan including a travel path for the compaction machine. In such an example, the travel path is substantially within the perimeter of the worksite surface. The controller is further configured to cause at least part of the travel path to be displayed via the control interface, and to control operation of the compaction machine on the worksite surface, in accordance with the compaction plan, based at least partly on receiving an input indicative of approval of the travel path.

DETAILED DESCRIPTION

Figure 1:
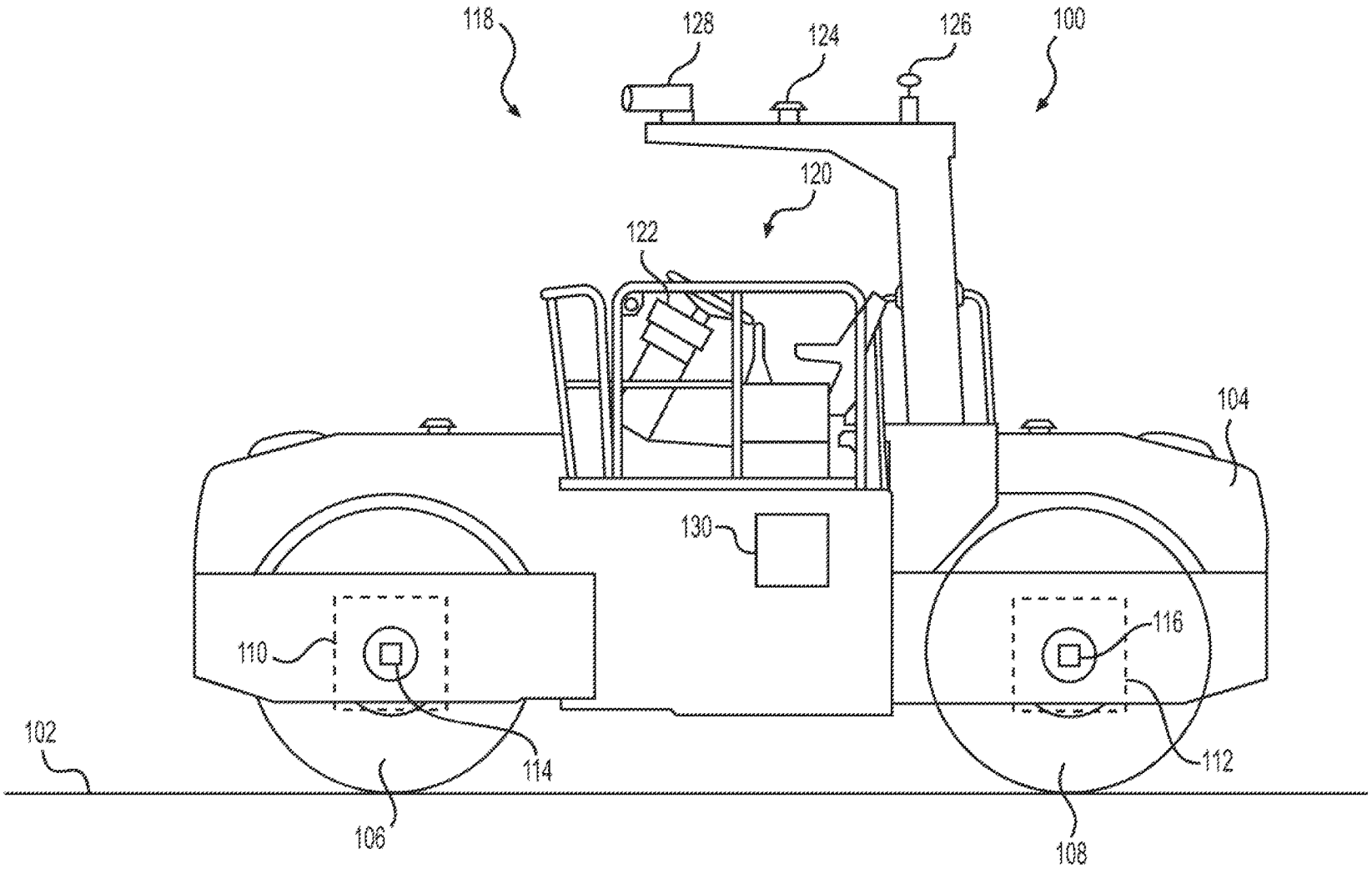
FIG. 1 is a side view of a compaction machine in accordance with an example embodiment of the present disclosure.

Wherever possible, the same reference numbers will be used throughout the drawings to refer to same or like parts. FIG. 1 shows an example machine 100. The machine 100 is illustrated as a compaction machine 100 which may be used, for example, for road construction, highway construction, parking lot construction, and other such paving and/or construction applications. For example, such a compaction machine 100 may be used in situations where it is necessary to compress loose stone, gravel, soil, sand, concrete, and/or other materials of a worksite surface 102 to a state of greater compaction and/or density. As the compaction machine 100 traverses the worksite surface 102, vibrational forces generated by the compaction machine 100 and imparted to the worksite surface 102, acting in cooperation with the weight of the compaction machine 100, may compress such loose materials. The compaction machine 100 may make one or more passes over the worksite surface 102 to provide a desired level of compaction. Although described above as being configured to compact primarily earth-based materials of the worksite surface 102, in other examples, the compaction machine 100 may also be configured to compact freshly deposited asphalt or other materials disposed on and/or associated with the worksite surface 102.

As shown in FIG. 1, an example compaction machine 100 may include a frame 104, a first drum 106, and a second drum 108. The first and second drums 106, 108 may comprise substantially cylindrical drums and/or other compaction elements of the compaction machine 100, and the first and second drums 106, 108 may be configured to apply vibration and/or other forces to the worksite surface 102 in order to assist in compacting the worksite surface 102. Although illustrated in FIG. 1 as having a substantially smooth circumference or outer surface, in other examples, the first drum 106 and/or the second drum 108 may include one or more teeth, pegs, extensions, bosses, pads, and/or other ground-engaging tools (not shown) extending from the outer surface thereof. Such ground-engaging tools may assist in breaking-up at least some of the materials associated with the worksite surface 102 and/or may otherwise assist in compacting the worksite surface 102. The first drum 106 and the second drum 108 may be rotatably coupled to the frame 104 so that the first drum 106 and the second drum 108 may roll over the worksite surface 102 as the compaction machine 100 travels.

The first drum 106 may have the same or different construction as the second drum 108. In some examples, the first drum 106 and/or the second drum 108 may be an elongated, hollow cylinder with a cylindrical drum shell that encloses an interior volume. The first drum 106 may define a first central axis about which the first drum 106 may rotate, and similarly, the second drum 108 may define a second central axis about which the second drum 108 may rotate. In order to withstand being in rolling contact with and compacting the loose material of the worksite surface 102, the respective drum shells of the first drum 106 and the second drum 108 may be made from a thick, rigid material such as cast iron or steel. The compaction machine 100 is shown as having first and second drums 106, 108. However, other types of compaction machines 100 may be suitable for use in the context of the present disclosure. For example, belted compaction machines or compaction machines having a single rotating drum, or more than two drums, are contemplated herein. Rather than a self-propelled compaction machine 100 as shown, the compaction machine 100 might be a tow-behind or pushed unit configured to couple with a tractor (not shown). An autonomous compaction machine 100 is also contemplated herein.

The first drum 106 may include a first vibratory mechanism 110, and the second drum 108 may include a second vibratory mechanism 112. While FIG. 1 shows the first drum 106 having a first vibratory mechanism 110 and the second drum 108 having a second vibratory mechanism 112, in other embodiments only one of the first and second drums 106, 108 may include a respective vibratory mechanism 110, 112. Such vibratory mechanisms 110, 112 may be disposed inside the interior volume of the first and second drums 106, 108, respectively. According to an example embodiment, such vibratory mechanisms 110, 112 may include one or more weights or masses disposed at a position off-center from the respective central axis around which the first and second drums 106, 108 rotate. As the first and second drums 106, 108 rotate, the off-center or eccentric positions of the masses induce oscillatory or vibrational forces to the first and second drums 106, 108, and such forces are imparted to the worksite surface 102. The weights are eccentrically positioned with respect to the respective central axis around which the first and second drums 106, 108 rotate, and such weights are typically movable with respect to each other (e.g., about the respective central axis) to produce varying degrees of imbalance during rotation of the first and second drums 106, 108. The amplitude of the vibrations produced by such an arrangement of eccentric rotating weights may be varied by modifying and/or otherwise controlling the position of the eccentric weights with respect to each other, thereby varying the average distribution of mass (i.e., the centroid) with respect to the axis of rotation of the weights. Vibration amplitude in such a system increases as the centroid moves away from the axis of rotation of the weights and decreases toward zero as the centroid moves toward the axis of rotation. Varying the rotational speed of the weights about their common axis may change the frequency of the vibrations produced by such an arrangement of rotating eccentric weights. In some applications, the eccentrically positioned weights are arranged to rotate inside the first and second drums 106, 108 independently of the rotation of the first and second drums 106, 108. The present disclosure is not limited to these embodiments described above. According to other alternative embodiments, the first and second vibratory mechanisms 110, 112 may be replaced with any other mechanisms that modify the compaction effort of the first drum 106 or the second drum 108. In particular, by altering the distance of the eccentric weights from the axis of rotation, the amplitude portion of the compaction effort is modified. By altering the speed of the eccentric weights around the axis of rotation, the frequency portion of the compaction effort is modified.

According to an exemplary embodiment, a sensor 114 may be located on the first drum 106 and/or a sensor 116 may be located on the second drum 108. In alternative embodiments, multiple sensors 114, 116 may be located on the first drum 106, the second drum 108, the frame 104, and/or other components of the compaction machine 100. In such examples, the sensors 114, 116 may comprise compaction sensors configured to measure, sense, and/or otherwise determine the density, stiffness, compaction, compactability, and/or other characteristics of the worksite surface 102. Such characteristics of the worksite surface 102 may be based on the composition, dryness, and/or other characteristics of the material being compacted. Such characteristics of the worksite surface 102 may also be based on the operation and/or characteristics of the first drum 106 and/or the second drum 108. For example, the sensor 114 coupled to first drum 106 may be configured to sense, measure, and/or otherwise determine the type of material, material density, material stiffness, and/or other characteristics of the worksite surface 102 proximate the first drum 106. Additionally, the sensor 114 coupled to the first drum 106 may measure, sense, and/or otherwise determine operating characteristics of the first drum 106 including a vibration amplitude, a vibration frequency, a speed of the eccentric weights associated with the first drum 106, a distance of such eccentric weights from the axis of rotation, a speed of rotation of the first drum 106, etc. Additionally, it is understood that the sensor 116 coupled to the second drum 108 may be configured to determine the type of material, material density, material stiffness, and/or other characteristics of the worksite surface 102 proximate the second drum 108, as well as a vibration amplitude, a vibration frequency, a speed of the eccentric weights associated with the second drum 108, a distance of such eccentric weights from the axis of rotation, a speed of rotation of the second drum 108, etc. It is not necessary to measure all of the operating characteristics of the first drum 106 or second drum 108 listed herein, instead, the above characteristics are listed for exemplary purposes.

With continued reference to FIG. 1, the compaction machine 100 may also include an operator station 118. The operator station 118 may include a steering system 120 including a steering wheel, levers, and/or other controls (not shown) for steering and/or otherwise operating the compaction machine 100. In such examples, the various components of the steering system 120 may be connected to one or more actuators, a throttle of the compaction machine 100, an engine of the compaction machine, a braking assembly, and/or other such compaction machine components, and the steering system 120 may be used by an operator of the compaction machine 100 to adjust a speed, travel direction, and/or other aspects of the compaction machine 100 during use. The operator station 118 may also include a control interface 122 for controlling various functions of the compaction machine 100. The control interface 122 may comprise an analog, digital, and/or touchscreen display, and such a control interface 122 may be configured to display, for example, at least part of a travel path and/or at least part of a compaction plan of the present disclosure. The control interface 122 may also support other allied functions, including for example, sharing various operating data with one or more other machines (not shown) operating in consonance with the compaction machine 100, and/or with a remote server or other electronic device.

The compaction machine 100 may further include a location sensor 124 connected to a roof of the operator station 118 and/or at one or more other locations on the frame 104. The location sensor 124 may be capable of determining a location of the compaction machine 100, and may include and/or comprise a component of a global positioning system (GPS). For example, the location sensor 124 may comprise a GPS receiver, transmitter, transceiver or other such device, and the location sensor 124 may be in communication with one or more GPS satellites (not shown) to determine a location of the compaction machine 100 continuously, substantially continuously, or at various time intervals. The compaction machine 100 may also include a communication device 126 configured to enable the compaction machine 100 to communicate with the one or more other machines, and/or with one or more remote servers, processors, or control systems located remote from the worksite at which the compaction machine 100 is being used. Such a communication device 126 may also be configured to enable the compaction machine 100 to communicate with one or more electronic devices located at the worksite and/or located remote from the worksite. In some examples, the communication device 126 may include a receiver configured to receive various electronic signals including position data, navigation commands, real-time information, and/or project-specific information. In some examples, the communication device 126 may also be configured to receive signals including information indicative of compaction requirements specific to the worksite surface 102. Such compaction requirements may include, for example, a number of passes associated with the worksite surface 102 and required in order to complete the compaction of the worksite surface 102, a desired stiffness, density, and/or compaction of the worksite surface 102, a desired level of efficiency for a corresponding compaction operation, and/or other requirements. The communication device 126 may further include a transmitter configured to transmit position data indicative of a relative or geographic position of the compaction machine 100, as well as electronic data such as data acquired via one or more sensors of the compaction machine 100. Additionally, the compaction machine 100 may include a camera 128. The camera 128 may be a state of the art camera capable of providing visual feeds and supporting other functional features of the compaction machine 100. In some examples, the camera 128 may comprise a digital camera configured to record and/or transmit digital video of the worksite surface 102 and/or other portions of the worksite in real-time. In still other examples, the camera 128 may comprise an infrared sensor, a thermal camera, or other like device configured to record and/or transmit thermal images of the worksite surface 102 in real-time. In some examples, the compaction machine 100 may include more than one camera 128 (e.g., a camera at the front of the machine and a camera at the rear of the machine).

The compaction machine 100 may also include a controller 130 in communication with the steering system 120, the control interface 122, the location sensor 124, the communication device 126, the camera 128, the sensors 114, 116, and/or other components of the compaction machine 100. The controller 130 may be a single controller or multiple controllers working together to perform a variety of tasks. The controller 130 may embody a single or multiple microprocessors, field programmable gate arrays (FPGAs), digital signal processors (DSPs), and/or other components configured to generate a compaction plan, one or more travel paths for the compaction machine 100 and/or other information useful to an operator of the compaction machine 100. Numerous commercially available microprocessors can be configured to perform the functions of the controller 130. Various known circuits may be associated with the controller 130, including power supply circuitry, signal-conditioning circuitry, actuator driver circuitry (i.e., circuitry powering solenoids, motors, or piezo actuators), and communication circuitry. In some embodiments, the controller 130 may be positioned on the compaction machine 100, while in other embodiments the controller 130 may be positioned at an off-board location and/or remote location relative to the compaction machine 100. The present disclosure, in any manner, is not restricted to the type of controller 130 or the positioning of the controller 130 relative to the compaction machine 100.

Figure 2:
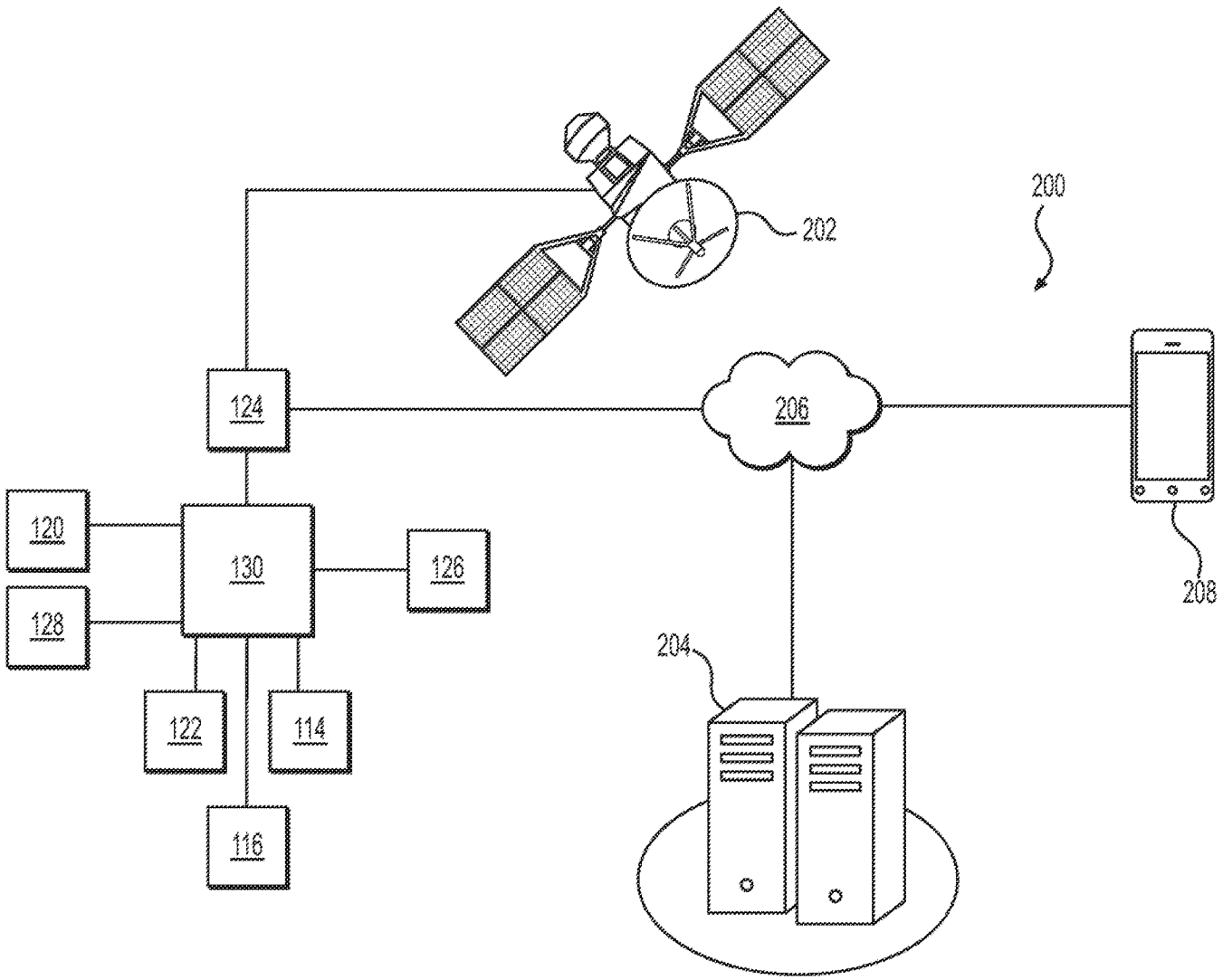
FIG. 2 is a block diagram schematically representing a control system associated with the compaction machine in accordance with an example embodiment of the present disclosure.

FIG. 2 is a block diagram schematically illustrating an example control system 200 of the present disclosure. In any of the examples described herein, the control system 200 may include at least one of the controller 130, the steering system 120, the control interface 122, the location sensor 124, the communication device 126, the camera 128, the sensors 114, 116, and/or any other sensors or components of the compaction machine 100. In such examples, the controller 130 may be configured to receive respective signals from such components. For example, the controller 130 may receive one or more signals from the location sensor 124 including information indicating a location of the compaction machine 100. In some examples, the location sensor 124 may be configured to determine the location of the compaction machine 100 as the compaction machine 100 traverses a perimeter of the worksite surface 102 and/or as the compaction machine 100 travels to any other worksite location. For example, the location sensor 124 may be configured to determine the location of the compaction machine 100 as the compaction machine 100 traverses a perimeter of an avoidance zone located substantially within the perimeter of the worksite surface 102. Such an avoidance zone may comprise an area and/or location of the worksite surface 102 that the compaction machine 100 may be prohibited from entering during a compaction operation. For example, such an avoidance zone may comprise a trench, ditch, body of water, manhole, electrical connection, wooded area, and/or any other area that may not require compaction.

As shown in FIG. 2, the location sensor 124 may be connected to and/or otherwise in communication with one or more satellites 202 or other GPS components configured to assist the location sensor 124 in determining the location of the compaction machine 100 in any of the example processes described herein. In some examples, such satellites 202 or other GPS components may comprise components of the control system 200. In any of the examples described herein, the location sensor 124 either alone or in combination with the satellite 202 may be configured to provide the controller with signals including information indicative of a location of the perimeter of the worksite surface 102, a location of the perimeter of an avoidance zone, the location of the compaction machine 100, and/or other information. Such information may include GPS coordinates of each point along such perimeters and/or of each point along a travel path of the compaction machine. Such information may be determined substantially continuously during movement of the compaction machine 100. Alternatively, such information may be determined at regular time intervals (milliseconds, one second, two seconds, five seconds, ten seconds, etc.) as the compaction machine 100 travels. Further, any such information may be stored in a memory associated with the controller 130. Such memory may be disposed on the compaction machine 100 and/or may be located in the cloud, on a server, and/or on any other electronic device located remote from the compaction machine 100. It is understood that in further examples information indicative of the location of the perimeter of the worksite surface 102, the location of the perimeter of an avoidance zone, and/or other information may be pre-loaded within the memory and may be obtained from one or more professional surveys, topographical maps, and/or other prior analysis of the worksite surface 102. In such examples, it may not be necessary to traverse the perimeter of the worksite surface 102 and/or the perimeter of the avoidance zone in order to determine such information.

The controller 130 may also receive respective signals from the sensors 114, 116. As noted above, the sensors 114, 116 may be configured to determine a density, stiffness, compactability, and/or other characteristic of the worksite surface 102. Such sensors 114, 116 may also be configured to determine the vibration frequency, vibration amplitude, and/or other operational characteristics of the first drum 106 and the second drum 108, respectively. In some examples, the sensor 114 may determine a density, stiffness, compactability, and/or other characteristic of a portion of the worksite surface 102 proximate the first drum 106 and/or located along a travel path of the compaction machine 100. The sensor 114 may send one or more signals to the controller 130 including information indicative of such a characteristic, and the controller 130 may control the vibratory mechanism 110 to modify at least one of a vibration frequency of the first drum 106 and a vibration amplitude of the first drum 106, as the compaction machine 100 traverses the travel path, based at least partly on such information. In such examples, the sensor 116 may determine one or more of the same characteristics of a portion of the worksite surface 102 proximate the second drum 108 and/or located along a travel path of the compaction machine 100. The sensor 116 may send one or more signals to the controller 130 including information indicative of such a characteristic, and the controller 130 may control the vibratory mechanism 112 to modify at least one of a vibration frequency of the second drum 108 and a vibration amplitude of the second drum 108, as the compaction machine 100 traverses the travel path, based at least partly on such information.

As will be described in greater detail below, in example embodiments the controller 130 may use information indicative of a location of a perimeter of the worksite surface 102, information indicative of a location of a perimeter of one or more avoidance zones, information indicative of one or more compaction requirements specific to the worksite surface 102, and/or any other received information to generate a compaction plan for the compaction machine 100 and associated with the worksite surface 102. Such a compaction plan may include a travel path for the compaction machine 100 that extends substantially within the perimeter of the worksite surface. In such examples, such a travel path may maintain the compaction machine 100 outside of the one or more avoidance zones. Such a compaction plan may include visual indicia indicating, among other things, the perimeter of the worksite surface 102, the perimeters of the one or more avoidance zones, and/or the travel path of the compaction machine 100. Such a compaction plan may also include a speed of the compaction machine 100, a vibration frequency of the first drum 106 and/or the second drum 108, a vibration amplitude of the first drum 106 and/or the second drum 108, and/or other operating parameters of the compaction machine 100. In such examples, such a compaction plan may also include visual indicia indicating one or more such operating parameters. The controller 130 may determine the compaction plan, the travel path, the speed of the compaction machine 100, a vibration frequency of the first drum 106 and/or the second drum 108, a vibration amplitude of the first drum 106 and/or the second drum 108, and/or other operating parameters of the compaction machine 100 using one or more compaction plan models, algorithms, neural networks, look-up tables, and/or through one or more additional methods. In an exemplary embodiment, the controller 130 may have an associated memory in which various compaction plan models, algorithms, look-up tables, and/or other components may be stored for determining the compaction plan, travel path, and/or operating parameters of the compaction machine 100 based on one or more inputs. Such inputs may include, for example, the circumference and/or width of the first and second drums 106, 108, the mass of the compaction machine 100, information indicative of the location of the perimeter of the worksite surface 102, information indicative of the location of the perimeter of an avoidance zone, information indicative of one or more compaction requirements specific to the worksite surface 102, and/or any other received information.

As shown in FIG. 2, the control system 200 may also include one or more additional components. For example, the control system 200 may include one or more remote servers, processors, or other such computing devices 204. Such computing devices 204 may comprise, for example, one or more servers, laptop computers, or other computers located at a paving material plant remote from the worksite at which the compaction machine 100 is being used. In such examples, the communication device 126 and/or the controller 130 may be connected to and/or otherwise in communication with such computing devices 204 via a network 206. The network 206 may be a local area network ("LAN"), a larger network such as a wide area network ("WAN"), or a collection of networks, such as the Internet. Protocols for network communication, such as TCP/IP, may be used to implement the network 206. Although embodiments are described herein as using a network such as the Internet, other distribution techniques may be implemented that transmit information via memory cards, flash memory, or other portable memory devices. The control system 200 may further include one or more tablets, mobile phones, laptop computers, and/or other mobile devices 208. Such mobile devices 208 may be located at the worksite or, alternatively, one or more such mobile devices 208 may be located at the paving material plant described above, or at another location remote from the worksite. In such examples, the communication device 126 and/or the controller 130 may be connected to and/or otherwise in communication with such mobile devices 208 via the network 206. In any of the examples described herein, information indicative of the location of the perimeter of the worksite surface 102, information indicative of the perimeter of an avoidance zone, a compaction plan, a travel path of the compaction machine 100, vibration amplitudes, vibration frequencies, a density, stiffness, or compactability of the worksite surface 102, and/or any other information received, processed, or generated by the controller 130 may be provided to the computing devices 204 and/or the mobile devices 208 via the network 206.

Figure 3:
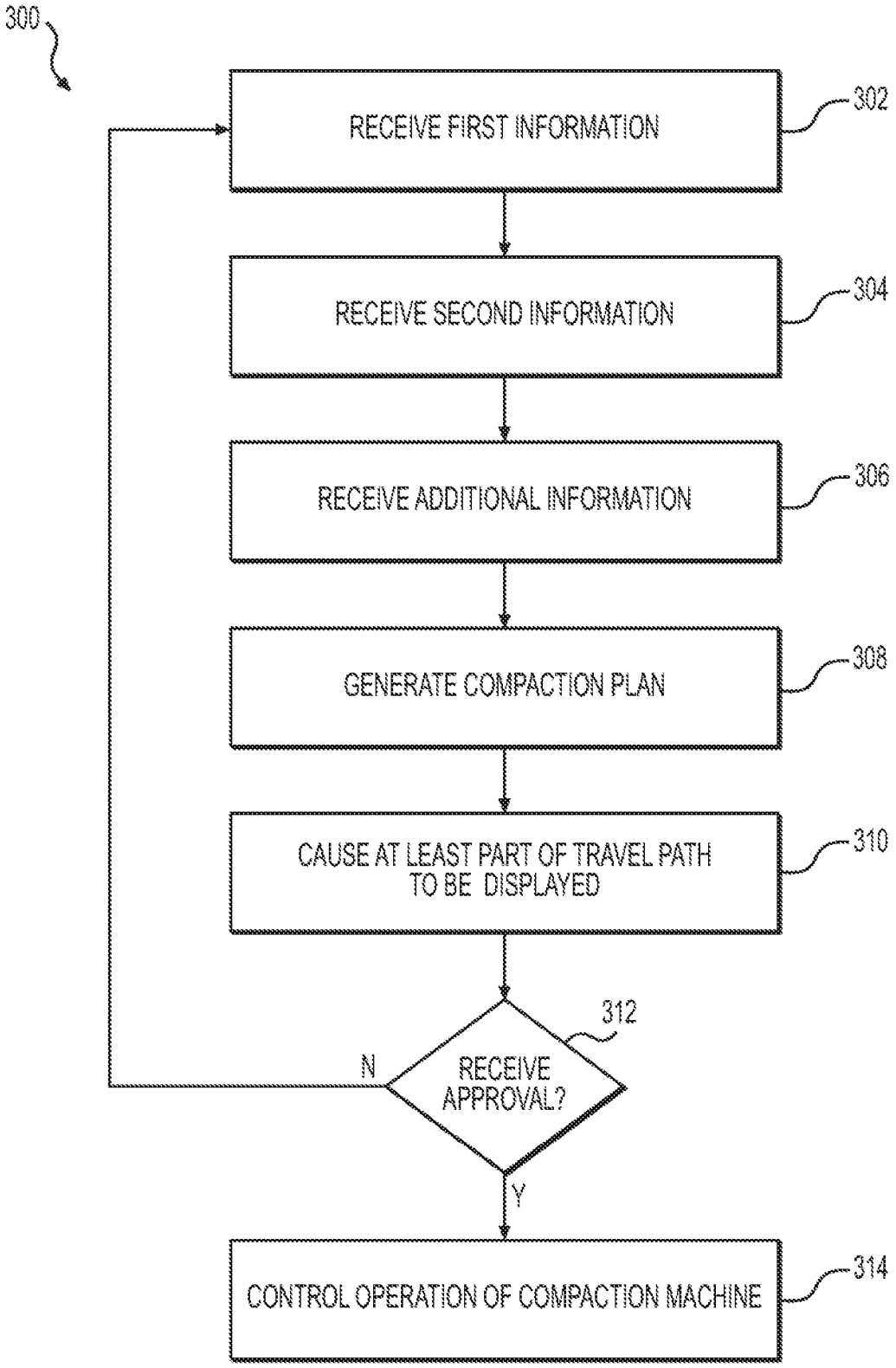
FIG. 3 is a flow chart depicting a method of generating a compaction plan in accordance with an example embodiment of the present disclosure.
Figure 4:
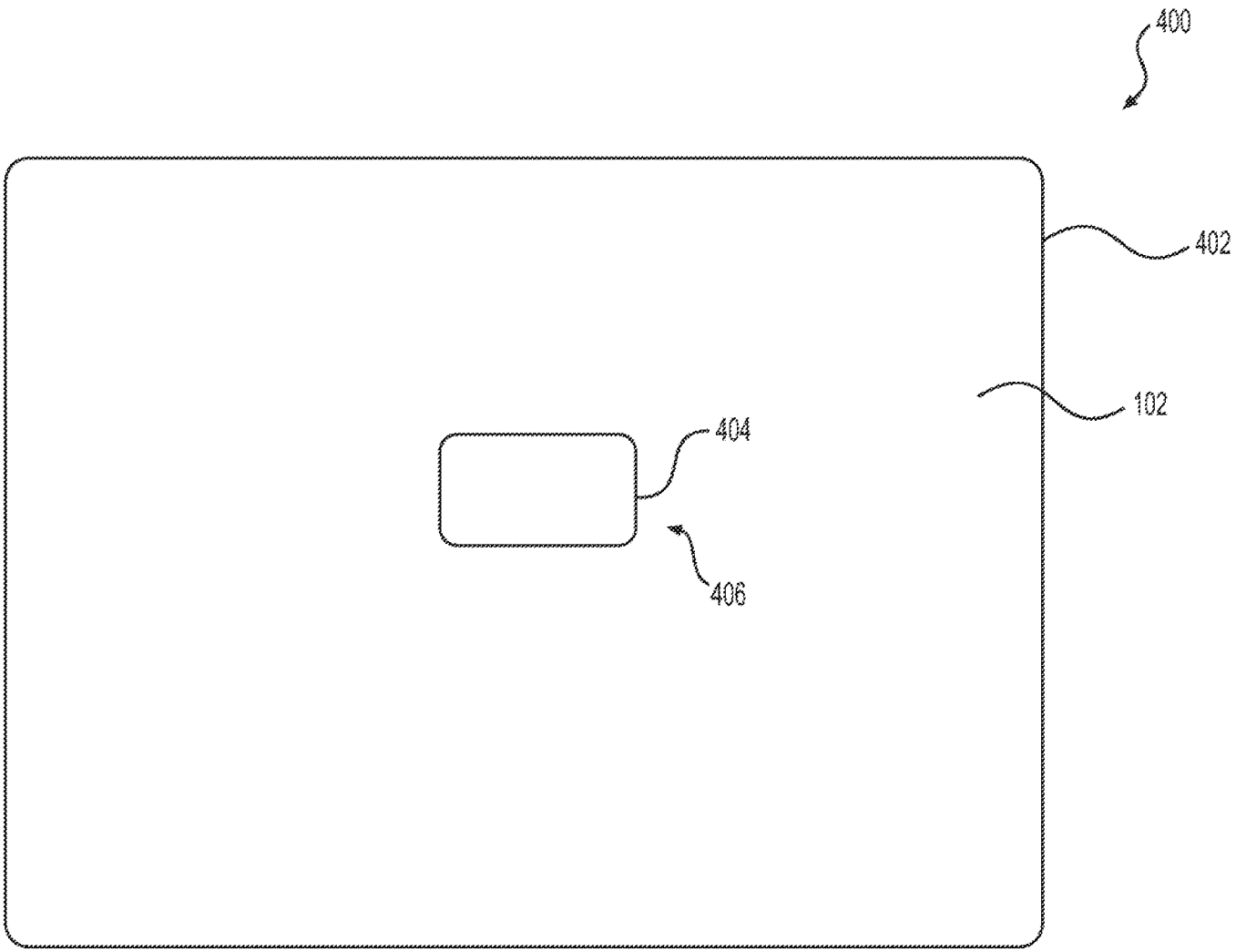
FIG. 4 is a schematic illustration of a worksite including a worksite surface according to an example embodiment of the present disclosure.

FIG. 3 illustrates a flow chart depicting a method 300 of generating a compaction plan in accordance with an example embodiment of the present disclosure. The example method 300 is illustrated as a collection of steps in a logical flow diagram, which represents operations that can be implemented in hardware, software, or a combination thereof. In the context of software, the steps represent computer-executable instructions stored in memory. When such instructions are executed by, for example, the controller 130, such instructions may cause the controller 130, various components of the control system 200, and/or the compaction machine 100, generally, to perform the recited operations. Such computer-executable instructions may include routines, programs, objects, components, data structures, and the like that perform particular functions or implement particular abstract data types. The order in which the operations are described is not intended to be construed as a limitation, and any number of the described steps can be combined in any order and/or in parallel to implement the process. For discussion purposes, and unless otherwise specified, the method 300 is described with reference to the compaction machine 100 of FIG. 1 and the control system 200 of FIG. 2. Various aspects of the method 300 will also be described with reference to FIGS. 4-10.

At 302, the controller 130 may receive first information from at least one of the sensors of the compaction machine 100, and/or may receive first information from one or more remote servers, processors, computing devices 204, electronic devices 208, and/or other components of the control system 200. For example, at 302 the location sensor 124 and/or other components of the control system 200 may determine a location of the compaction machine 100 on the worksite surface 102 substantially continuously or at predetermined intervals of time (e.g., every millisecond, every second, every two seconds, every five seconds, etc.). In such examples, the location sensor 124 and/or other components of the control system 200 may generate one or more signals including information indicative of the location of the compaction machine 100, and may provide such signals to the controller 130. Accordingly, at 302 the controller 130 may receive one or more signals from the location sensor 124 and/or other components of the control system 200, and such signals may include GPS coordinates (e.g., latitude and longitude coordinates), map information, and/or other information determined by the location sensor 124 and indicating the location of the compaction machine 100. Such signals may also include timestamp information indicating the moment in time (e.g., hour, minute, second, millisecond, etc.) at which the location information or other information included in the signal was determined.

In an example method of the present disclosure, at 302 an operator may drive the compaction machine 100 along a perimeter of the worksite surface 102. Such an example worksite surface 102 is illustrated by the example worksite 400 shown in FIG. 4. In such examples, the worksite 400 may include a worksite surface 102 having a perimeter 402. In such examples, the worksite surface 102 may also include one or more avoidance zones as described above. A perimeter 404 of an example avoidance zone 406 is also illustrated in the worksite 400 of FIG. 4. In such examples, at 302 the controller 130 may receive first information indicative of the location of the perimeter 402 of the worksite surface 102 from the location sensor 124 based at least partly on the compaction machine 100 traversing the perimeter 402 of the worksite surface 102. In such examples, the operator may drive the compaction machine 100 along a perimeter 402 of the worksite surface 102 from an operator station located on the machine or, alternatively, from a remote location through the use of a remote control interface that is in communication with the compaction machine 102. Additionally or alternatively, as noted above information indicative of the location of the perimeter 402 may be obtained from one or more professional surveys, topographical maps, and/or other prior analysis of the worksite surface 102, and such information may be pre-loaded within a memory in communication with the controller 130. For example, a prior analysis of the worksite may be generated from position and location data collected by another machine that performs preparatory work on the worksite prior to compaction, such as a motor grader or rotary mixer. In these examples, the perimeter 402 of the worksite may be calculated or otherwise determined from the path taken by the preparatory machine. In any of the above examples, such information may be obtained from the memory and/or otherwise received by the controller 130 at 302. Additionally, in such examples the operator may not be required to drive the compaction machine 100 along the perimeter 402 in order to collect such information.

At 304, the controller 130 may receive second information indicative of, for example, one or more compaction requirements specific to the worksite surface 102, and/or specific to worksite 400, generally. As noted above, such compaction requirements may include, among other things, a number of passes associated with the worksite surface 102 and required in order to complete the compaction of the worksite surface 102, a desired stiffness, density, and/or compaction of the worksite surface 102, a desired level of efficiency for a corresponding compaction operation, and/or other requirements. Additionally or alternatively, such compaction requirements may include desired vibration frequencies (e.g., a number of impacts per unit distance) and/or vibration amplitudes for the first drum 106 and/or the second drum 108. Such compaction requirements may also include a desired amount of overlap (one inch, two inches, six inches, one foot, etc.) between sequential passes of the compaction machine 100. Such compaction requirements may be received from, for example, an operator of the compaction machine 100, and may be received by the controller 130 at 304 via, for example, the control interface 122. Additionally or alternatively, such compaction requirements may be received from a foreman at the worksite 400, an employee of a remote paving materials, plant, and/or any other source associated with the worksite 400. In such examples, such compaction requirements may be received by the controller 130 at 304 via, for example, one or more remote servers, processors, computing devices 204, electronic devices 208, and/or other components of the control system 200. In some examples, such compaction requirements may also be pre-loaded within a memory in communication with the controller 130. In such examples, such compaction requirements may be obtained from the memory and/or otherwise received by the controller 130 at 304.

At 306, the controller 130 may receive additional information (e.g., third information) from at least one of the sensors of the compaction machine 100, and/or may receive such additional information from one or more remote servers, processors, computing devices 204, electronic devices 208, and/or other components of the control system 200. For example, at 306 an operator may drive the compaction machine 100 along the perimeter 404 of the avoidance zone 406. In such examples, and as noted above with respect to 302, the location sensor 124 and/or other components of the control system 200 may determine a location of the compaction machine 100 as the compaction machine 100 traverses the perimeter 404 of the avoidance zone 406. The location sensor 124 and/or other components of the control system 200 may generate one or more signals including information indicative of the location of the perimeter 404, and may provide such signals to the controller 130. Accordingly, at 306 the controller 130 may receive one or more signals from the location sensor 124 and/or other components of the control system 200, and such signals may include GPS coordinates (e.g., latitude and longitude coordinates), map information, and/or other information determined by the location sensor 124 and indicating the location of the perimeter 404 of the avoidance zone 406. Such signals may also include timestamp information indicating the moment in time (e.g., hour, minute, second, millisecond, etc.) at which the location information or other information included in the signal was determined.

Additionally or alternatively, as noted above information indicative of the location of the perimeter 404 may be obtained from one or more professional surveys, topographical maps, and/or other prior analysis of the worksite surface 102, and such information may be pre-loaded within a memory in communication with the controller 130. In such examples, such information may be obtained from the memory and/or otherwise received by the controller 130 at 306. Additionally, in such examples the operator may not be required to drive the compaction machine 100 along the perimeter 404 in order to collect such information.

Figure 5:
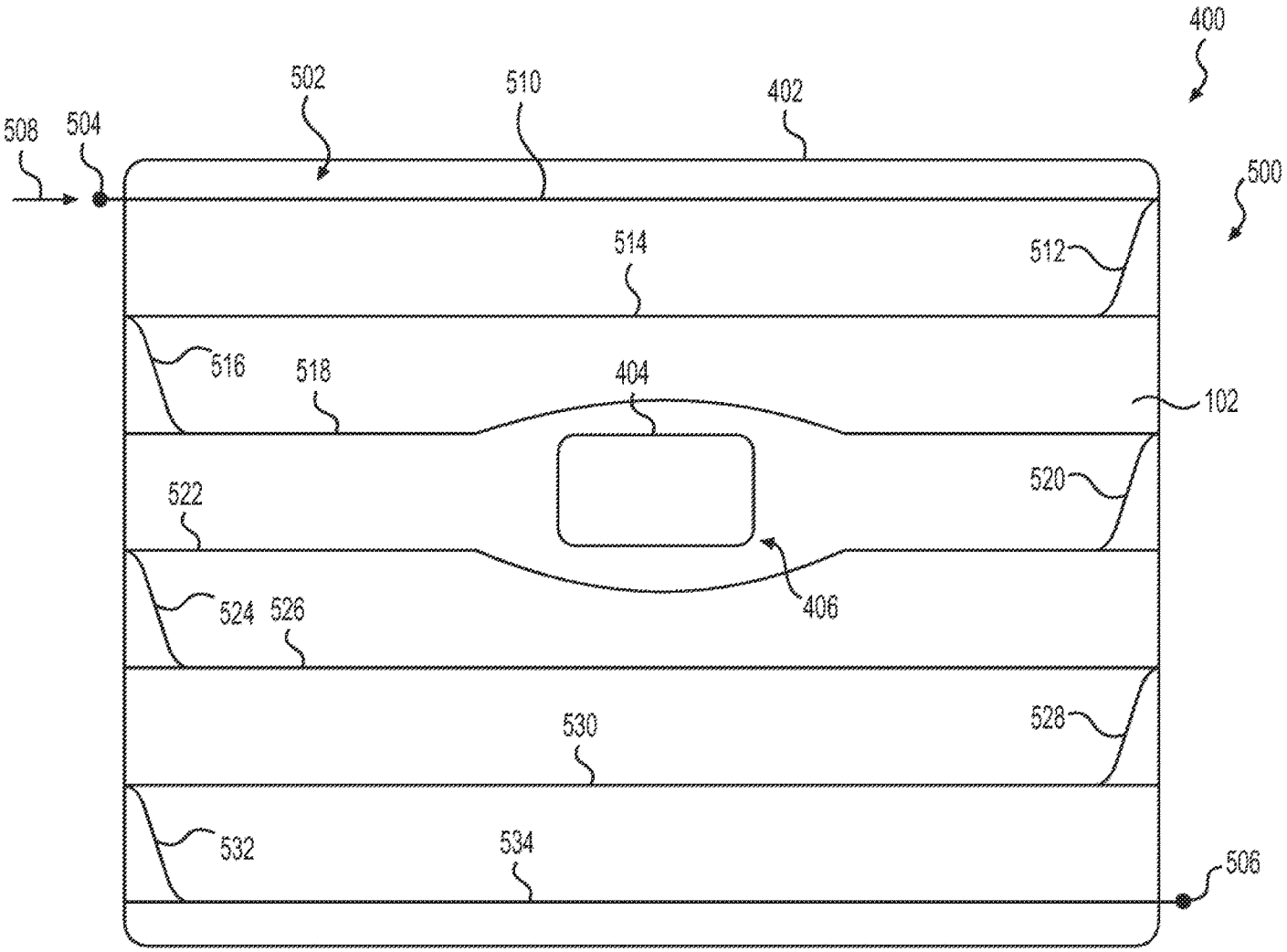
FIG. 5 is a schematic illustration of the worksite shown in FIG. 4, together with a visual illustration of a corresponding compaction plan, according to an example embodiment of the present disclosure.

At 308, the controller 130 may generate a compaction plan based at least partly on the first information received at 302, the second information received at 304, and/or the additional information received at 306. A visual illustration of at least part of such an example compaction plan 500 is shown in FIG. 5. An example compaction plan 500 may include a travel path 502 for the compaction machine 100 that is substantially within the perimeter 402 of the worksite surface 102. The compaction plan 500 generated by the controller 130 at 308, and in particular, the travel path 502 of the compaction plan 500, may be configured to maintain the compaction machine 100 outside of the avoidance zone 406. For example, the travel path 502 may be arranged such that the compaction machine 100 does not cross the perimeter 404 of the avoidance zone 406 during a compaction operation that is performed in accordance with the compaction plan 500. Such a compaction plan 500 may also include a speed of the compaction machine 100, a vibration frequency of the first drum 106 and/or the second drum 108, a vibration amplitude of the first drum 106 and/or the second drum 108, steering instructions for autonomous/semi-autonomous control of the compaction machine 100, braking instructions for autonomous/semi-autonomous control of the compaction machine 100, and/or other operating parameters of the compaction machine 100. Additionally, such a compaction plan 500 may include an estimated time required to complete the corresponding compaction operation, an estimated maximum coverage amount/percentage, a maximum amount of acceptable overlap between sequential passes of the compaction machine 100, and/or other values or metrics associated with the compaction operation. Any of the values, metrics, parameters or information described above may be determined by the controller 130 at 308.

At 308, the controller 130 may generate the compaction plan 500, the travel path 502, the speed of the compaction machine 100, a vibration frequency of the first drum 106 and/or the second drum 108, a vibration amplitude of the first drum 106 and/or the second drum 108, and/or other operating parameters of the compaction machine 100 using one or more compaction plan models, algorithms, neural networks, look-up tables, and/or through one or more additional methods. As noted above, the controller 130 may have an associated memory in which various compaction plan models, algorithms, look-up tables, and/or other components may be stored for determining the compaction plan 500, travel path 502, and/or operating parameters of the compaction machine 100 based on one or more inputs. Such inputs may include, for example, the circumference and/or width of the first and second drums 106, 108, the mass of the compaction machine 100, information indicative of the location of the perimeter 402 of the worksite surface 102, information indicative of the location of the perimeter 404 of the avoidance zone 406, information indicative of one or more compaction requirements specific to the worksite surface 102, the stiffness, density, compactability, composition, moisture content (e.g., dryness/wetness), and/or other characteristics of the worksite surface 102, and/or any other received information In example embodiments, the compaction plan 500 may take various different forms. For example, the compaction plan 500 may comprise one or more text files, data files, video files, digital image files, thermal image files, and/or any other such electronic file that may be stored within a memory associated with the controller 130, that may be executed by the controller 130, and/or that may be transferred from the controller 130 to a computing device 204 and/or a mobile device 208 via the network 206. In some examples, the compaction plan 500 may comprise a graphical representation (e.g., a visible image) of the worksite 400, worksite surface 102, perimeter 402, avoidance zone 406, perimeter 404, compaction machine 100, travel path 502, direction of travel of the compaction machine 100, and/or other items or objects useful to an operator of the compaction machine 100 while performing a compaction operation. In any of the examples described herein, the compaction plan 500 may include various information corresponding to and/or indicative of the information received at steps 302-306, and/or of other information received during the compaction operation. Such a compaction plan 500 may also include additional information to assist, for example, an operator of the compaction machine 100 in adjusting operating parameters of the compaction machine 100 in order to optimize performance and/or efficiency. Such compaction plans 500 may also include information to assist, for example, a foreman at the worksite 400 or a paving material plant employee manage haul truck delivery schedules, paving material plant temperatures, operation of other compaction and/or paving machines at the worksite 400, and/or other aspects of the compaction process in order to optimize performance and/or efficiency.

As shown in FIG. 5, a visual illustration of an example compaction plan 500 may include one or more lines, dots, arrows, shapes, and/or other visual indicia that correspond to and/or indicate the travel path 502, a start location 504 of the travel path 502, an end location 506 of the travel path 502, a direction of travel 508 for the compaction machine 100 along the travel path 502, as well as other information. An example visual illustration of the compaction plan 500 may also include one or more lines, dots, arrows, shapes, and/or other visual indicia that correspond to and/or indicate acceleration, deceleration, and various passes, turns, or other maneuvers to be made by the compaction machine 100 as the compaction machine 100 traverses the travel path 502. For example, as shown in FIG. 5 an example travel path 502 may include one or more passes across the worksite surface 102. In some examples, the travel path 502 may include a plurality of sequential passes across the worksite surface 102, and the compaction requirements received at 304 may specify that the compaction machine 100 is required to travel along the travel path 502 (e.g., from the start location 504 to the end location 504) a predetermined number of times, (e.g., 2 times, 3 times, 4 times, etc.). In particular, the example travel path 502 shown in FIG. 5 includes a first pass 510, a first turn 512, a second pass 514, a second turn 516, a third pass 518, a third turn 520, a fourth pass 522, a fourth turn 524, a fifth pass 526, a fifth turn 528, a sixth pass 530, a sixth turn 532, and a seventh pass 534. In some examples, and depending upon the shape, size, and/or other configuration of the worksite surface 102, one or more of the passes included in the travel path 502 may be substantially parallel to one another. Also, it is understood that any of the example travel paths 502 described herein may include greater than or less than the number of passes, turns, and/or other parameters illustrated in FIG. 5. Additionally, the compaction machine 100 may travel in forward and/or reverse directions along any of the passes (e.g., passes 510, 514, 518, 522, 526, 530, 534) and/or turns included in the travel path 502. Further, any of the turns (e.g., turns 512, 516, 520, 524, 528, 532) included in the travel path 502 may be "K" turns, "S" turns, and/or any other type of turning maneuver. As shown in FIG. 5, for example, the compaction machine 100 may travel from left to right (i.e., in the direction of arrow 508) along pass 510, and may reverse direction to travel along the turn 512. The compaction machine 100 may then travel in the direction of arrow 508 to the perimeter 402. Upon reaching the perimeter 402, the compaction machine 100 may travel in a direction opposite arrow 508, along the pass 514 until reaching the perimeter 402 and/or making the turn 516. A similar process may be repeated for any of the turns (e.g., turns 516, 520, 524, 528, 532) included in the travel path 502. Moreover, in any of the examples described herein, the compaction machine 100 may be controlled to remain within the perimeter 402. For example, the travel path 502 may prohibit the compaction machine 100 from crossing and/or exiting the perimeter 402.

In some examples, a visual illustration of the compaction plan 500 may also include one or more additional indicators comprising, for example, labels, location names, GPS coordinates of respective locations on the worksite surface 102, and/or other information determined at 308. In some examples, such indicators may include text, images, icons, markers, segments, linear demarcations, hash marks, and/or other visual indicia indicating various increments of distance traveled by the compaction machine 100. For example, a visual illustration of the example compaction plan 500 may include a plurality of hash marks (not shown) along the travel path 502 indicative of five feet, ten feet, twenty feet, fifty feet, one hundred feet, or any other increment of distance traveled by the compaction machine 100 along the travel path 502. In such examples, generating the compaction plan 500 at 308 may include determining such names, GPS coordinates, increments of distance, and/or other parameters associated with the worksite 400, the worksite surface 102, and/or the travel path 502. Further, in some examples, generating the compaction plan 500 at 308 may include determining for the first drum 106 and/or the second drum 108, at least one of a vibration frequency and a vibration amplitude corresponding to each pass of the plurality of passes (e.g., the plurality of sequential passes) included in the travel path 502. In such examples, a visual illustration of the compaction plan 500 may include text and/or other visual indicia indicating such frequencies and/or amplitudes.

In any of the examples described herein, various methods may be used by the controller 130 at 308 to generate the compaction plan 500, and the various example methods described herein with respect to at least FIGS. 4-7 should not be construed as limiting the present disclosure in any way. Instead, it is understood that at 308, the controller 130 may, in general, determine a surface area of the worksite surface 102 to be compacted using the first information received at 302 corresponding to the perimeter 402 of the worksite surface 102, the second information received at 306, and/or any additional information received at 306 corresponding to the perimeter 404 of one or more avoidance zones 406 (if any) associated with the worksite surface 102. Any of a number of trigonometric formulas, algorithms, look-up tables, or other methods may be used by the controller 130 at 308 to determine the surface area of the worksite surface 102. At 308, the controller 130 may generate the compaction plan 500 based at least in part on such a surface area, as well as the shape and/or other configurations of the worksite surface 102. In any of the examples described herein, the controller 130 may determine a compaction plan 500 at 308 including a travel path 502 that will optimize the efficiency of the compaction operation at the worksite 400. In such examples, the efficiency with which the compaction machine 100 performs a compaction operation may comprise a metric indicating the amount of time required to perform the compaction operation, the consistency with which the worksite surface 102 has been compacted, and the level of redundancy (e.g., unnecessary over-rolling) associated with compacting various portions of the worksite surface 102. For example, a compaction operation performed in a relatively short period of time, with a relatively high level of compaction consistency within the worksite surface 102, and a relatively low level of compaction redundancy will be regarded as having a relatively high efficiency. On the other hand, a compaction operation performed in a relatively long period of time, with a relatively low level of compaction consistency within the worksite surface 102, and with a relatively high level of compaction redundancy will be regarded as having a relatively low efficiency. Various example processes for generating a compaction plan will be described in greater detail below with respect to at least FIGS. 5-7.

In some examples, generating a compaction plan 500 at 308 may include determining one or more polygonal shapes having dimensions and/or other configurations that match and/or correspond, at least in part, to the perimeter 402 of the worksite surface 102. In such examples, the controller 130 may correlate and/or otherwise match the information received at 302 with a best-fit polygonal shape stored in the memory associated with the controller 130. The controller 130 may determine the surface area of the worksite surface 102 to be compacted based at least partly on algorithms, formulas, look-up tables and/or other processes associated with such a polygonal shape, and may generate the travel path 502 based at least partly on the surface area(s) determined using such algorithms, formulas, look-up tables and/or other processes.

In examples in which the perimeter 402 of the worksite 102 matches a single polygonal shape, the corresponding compaction plan 500 generated at 308 may comprise a travel path 502 having a plurality of sequential passes as described above, and each of the passes may cause the compaction machine 100 to travel in either direction of travel 508, or in a direction opposite the direction of travel 508. Such a travel path 502 may maximize the efficiency with which the compaction machine 100 may perform the compaction operation on the worksite surface 102. For example, the substantially rectangular worksite surface 102 shown in FIG. 5 may be illustrative of a worksite 400 comprising a parking lot, roadway, and/or other such structure having a substantially uniform shape and/or that substantially corresponds to a single polygonal shape (e.g., a rectangle) stored in the memory associated with the controller 130. The compaction plan 500 and corresponding travel path 502 shown in FIG. 5 may, thus, be generated at 308 to maximize the efficiency with which the compaction machine 100 may perform a compaction operation on the substantially rectangular worksite surface 102, while avoiding one or more avoidance zones 406.

In other examples, however, a worksite surface may include a perimeter have a shape, size, and/or other configuration that does not closely match with and/or substantially correspond to a single polygonal shape stored in the memory associated with the controller 130. In such examples, generating a compaction plan 500 may include determining a first polygonal shape that substantially matches and/or that corresponds to a first portion of the worksite surface, and determining one or more additional polygonal shapes that match and/or correspond to one or more corresponding additional portions of the worksite surface. In such situations, the controller 130 may determine a total surface area of the worksite surface by, for example, determining and summing the surface areas of the respective polygonal shapes corresponding to each portion of the worksite surface. At 308, the controller 130 may generate the compaction plan based at least in part on such a determined surface area.

Figure 6:
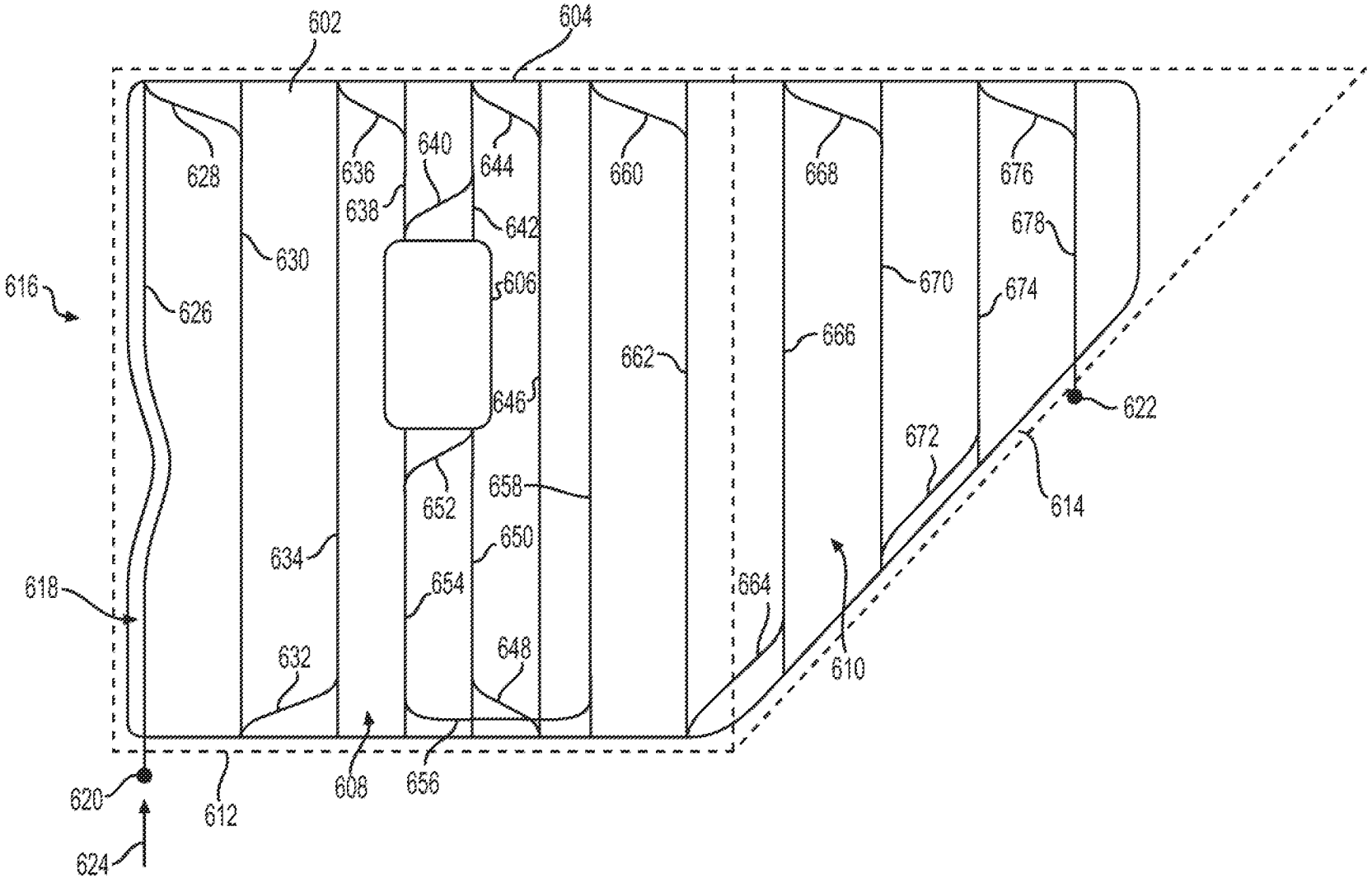
FIG. 6 is a schematic illustration of a worksite, together with a visual illustration of a corresponding compaction plan, according to another example embodiment of the present disclosure.

By way of example, FIG. 6 illustrates a worksite 600 including a worksite surface 602 having a relatively irregular shape. The worksite surface 602 includes a perimeter 604, and the worksite surface 602 also includes an avoidance zone having a perimeter 606. In such examples, upon receiving the first information at 302 the controller 130 may determine that the perimeter 604 of the worksite surface 602 does not correlate with and/or otherwise match a best fit polygonal shape stored in the memory associated with the controller 130. Based at least partly on making such a determination, the controller 130 may determine two or more polygonal shapes having dimensions that, in combination, correlate with and/or otherwise relatively closely match the overall shape of the perimeter 604. In such examples, the controller 130 may, at 308, segment, the worksite surface 602 into two or more portions by determining respective polygonal shapes having dimensions that substantially match each portion of the worksite surface 602. For example, at 308 the controller 130 may segment the worksite surface 602 into a first portion 608, and a second portion 610 adjacent to the first portion 608. In such examples, the controller 130 may determine a first polygonal shape 612 (e.g., a rectangle) having a shape and dimensions matching the first portion 608 of the worksite surface 602. In particular, the controller 130 may determine a first polygonal shape 612 having a perimeter that substantially matches the dimensions of a corresponding perimeter of the first portion 608. The controller 130 may also determine a second polygonal shape 614 (e.g., a triangle) having a shape and dimensions matching the second portion 610 of the worksite surface 602. In particular, the controller 130 may determine a second polygonal shape 614 having a perimeter that substantially matches the dimensions of a corresponding perimeter of the second portion 610.

By segmenting the worksite surface 602 in this manner, the controller 130 may, at 308, accurately determine the total surface area of a relatively irregularly shaped worksite surface 602, and may generate a compaction plan 616 and corresponding travel path 618 that may maximize the efficiency with which the compaction machine 100 may perform a compaction operation on the worksite surface 602. It is understood that, at 308, the controller 130 may incorporate (e.g., subtract) the shape, size, and location of any avoidance zones associated with such a worksite surface 602 when determining the total surface area of the worksite surface 602 to be compacted and/or when generating the compaction plan 616.

As shown in FIG. 6, a visual illustration of such an example compaction plan 616 may include one or more lines, dots, arrows, shapes, and/or other visual indicia that correspond to and/or indicate the travel path 618, a start location 620 of the travel path 618, an end location 622 of the travel path 618, a direction of travel 624 for the compaction machine 100 along the travel path 618, as well as other information. An example visual illustration of the compaction plan 616 may also include one or more lines, dots, arrows, shapes, and/or other visual indicia that correspond to and/or indicate various passes, turns, or other maneuvers to be made by the compaction machine 100 as the compaction machine 100 traverses the travel path 618. For example, as shown in FIG. 6 an example travel path 618 may include one or more passes across the worksite surface 602. In some examples, the travel path 618 may include a plurality of sequential passes across the worksite surface 602. In particular, the example travel path 618 shown in FIG. 6 includes a first pass 626, a first turn 628, a second pass 630, a second turn 632, a third pass 634, a third turn 636, a fourth pass 638, a fourth turn 640, a fifth pass 642, a fifth turn 644, a sixth pass 646, a sixth turn 648, a seventh pass 650, a seventh turn 652, an eighth pass 654, an eighth turn 656, and a ninth pass 658, a ninth turn 660, and a tenth pass 662. The above plurality of passes may comprise a first plurality of sequential passes substantially within the first portion 608 of the worksite surface 602. Additionally, the example travel path 618 includes a tenth turn 664, an eleventh pass 666, an eleventh turn 668, a twelfth pass 670, a twelfth turn 672, a thirteenth pass 674, a thirteenth turn 676, and a fourteenth pass 678. In such examples, the passes 666, 670, 674, 678 may comprise a second plurality of sequential passes substantially within the second portion 610 of the worksite surface 602. It is understood that any of the example travel paths 618 described herein may include greater than or less than the number of passes, turns, and/or other parameters illustrated in FIG. 6.

In some examples, segmenting the worksite surface 602 as described above with respect to FIG. 6 may increase the efficiency with which the compaction machine 100 may perform a compaction operation on an irregularly shaped worksite surface 602, while avoiding any avoidance zones associated with such a worksite surface 602. It is also understood that, in some examples, increasing the segmentation of a particular worksite surface (e.g., increasing the number of segments formed) may further increase the efficiency of the resulting compaction operation. For example, increasing the segmentation of a particular worksite surface at 308 may provide a more granular approach to generating a compaction plan, and in particular, may result in a travel path for the compaction machine 100 that more closely matches the various shapes, sizes, contours, and/or other configurations of the worksite surface. An example in which the segmentation of the worksite surface 602 has been increased, relative to the process described above with respect to FIG. 6, is shown in FIG. 7.

Figure 7:
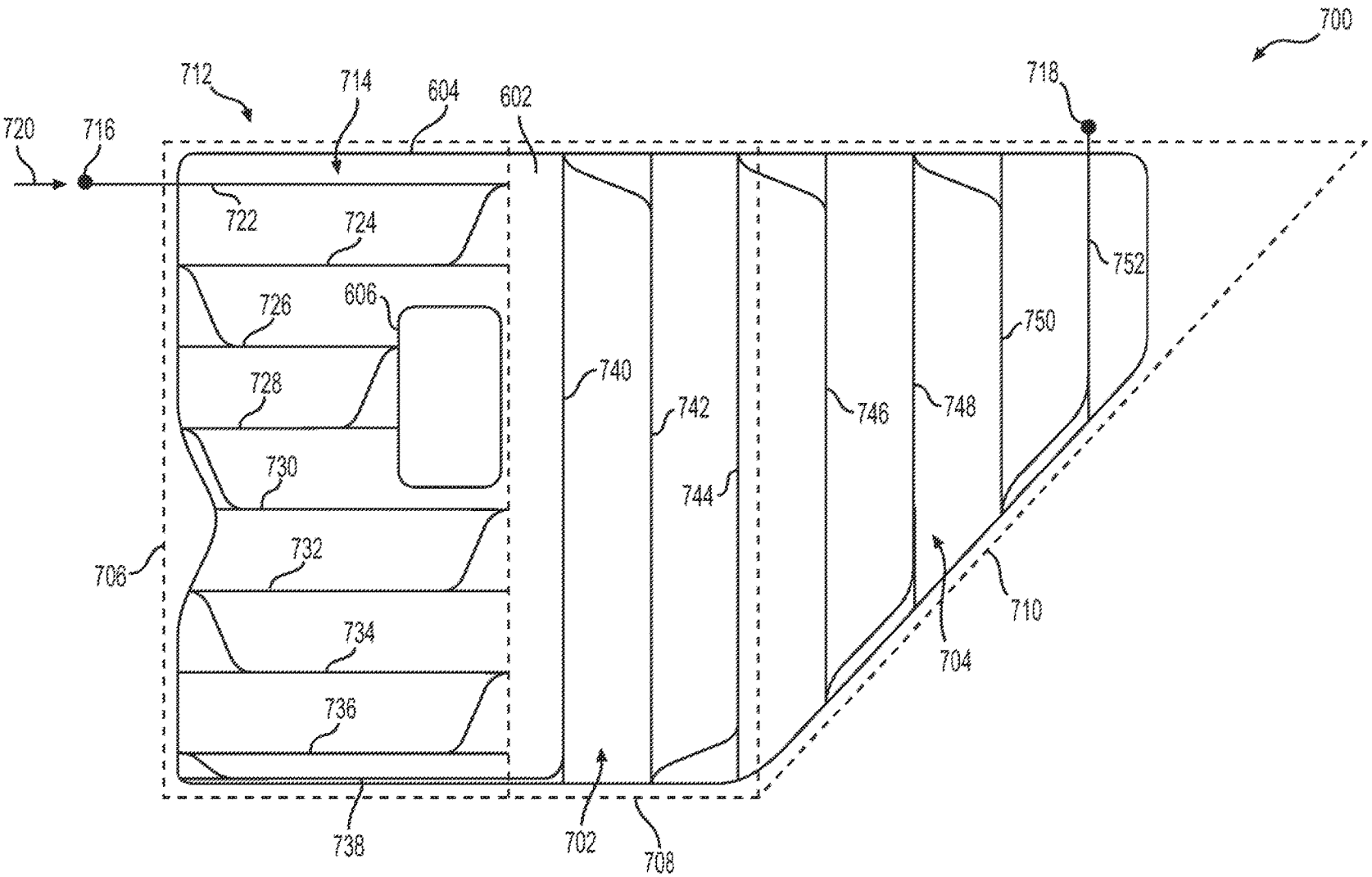
FIG. 7 is a schematic illustration of the worksite shown in FIG. 6, together with a visual illustration of a corresponding compaction plan, according to yet another example embodiment of the present disclosure.

In particular, FIG. 7 illustrates the example worksite 600 and worksite surface 602 shown in FIG. 6. In the example shown in FIG. 7, however, the controller 130 has, at 308, segmented the worksite surface 602 into a first portion 700, a second portion 702 adjacent to the first portion 700, and a third portion 704 adjacent to the second portion 702. In such examples, the controller 130 may determine a first polygonal shape 706 (e.g., a rectangle) having a shape and dimensions matching the first portion 700 of the worksite surface 602, a second polygonal shape 708 (e.g., a rectangle) having a shape and dimensions matching the second portion 702 of the worksite surface 602, and a third polygonal shape 710 having a shape and dimensions matching the third portion 704. By segmenting the worksite surface 602 in this manner, the controller 130 may generate a compaction plan 712 and corresponding travel path 714 that may maximize the efficiency with which the compaction machine 100 may perform a compaction operation on the irregularly shaped worksite surface 602, while avoiding any avoidance zones associated with such a worksite surface 602. Because the combination of polygonal shapes described with respect to FIG. 7 may more closely match the various shapes, sizes, contours, and/or other configurations of the worksite surface 602 than, for example, the combination of polygonal shapes described with respect to FIG. 6, the efficiency associated with the compaction plan 712 may be higher than the efficiency associated with the compaction plan 616.

As shown in FIG. 7, a visual illustration of such an example compaction plan 712 may include one or more lines, dots, arrows, shapes, and/or other visual indicia that correspond to and/or indicate the travel path 714, a start location 716 of the travel path 714, an end location 718 of the travel path 714, a direction of travel 720 for the compaction machine 100 along the travel path 714, as well as other information. An example visual illustration of the compaction plan 712 may also include one or more lines, dots, arrows, shapes, and/or other visual indicia that correspond to and/or indicate various passes, turns, or other maneuvers to be made by the compaction machine 100 as the compaction machine 100 traverses the travel path 714. For example, as shown in FIG. 7 an example travel path 714 may include one or more passes across the worksite surface 602. In some examples, the travel path 714 may include a plurality of sequential passes across the worksite surface 602. In particular, the example travel path 714 includes a first plurality of passes 722-738, and a second plurality of passes 740-752. The compaction machine 100 may travel in direction of travel 720 (e.g., in a forward direction) and/or in a direction opposite the direction of travel 720 (e.g., in a reverse direction) in any of the passes 722-752.

With continued reference to FIG. 3 and, for example, the compaction plan 500, travel path 504, and worksite 400 shown in FIG. 5, at 310 the controller 130 may cause at least part of the travel path 502 and/or other components of the compaction plan 500 to be displayed via the control interface 122 of the compaction machine 100. In some examples, at 310 the controller 130 may cause at least part of the travel path 502 to be displayed together with other indicators or visual indicia indicating the start location 504, the end location 506, the direction of travel 508, and/or other visual representations of portions of the compaction plan 500.

Figure 8:
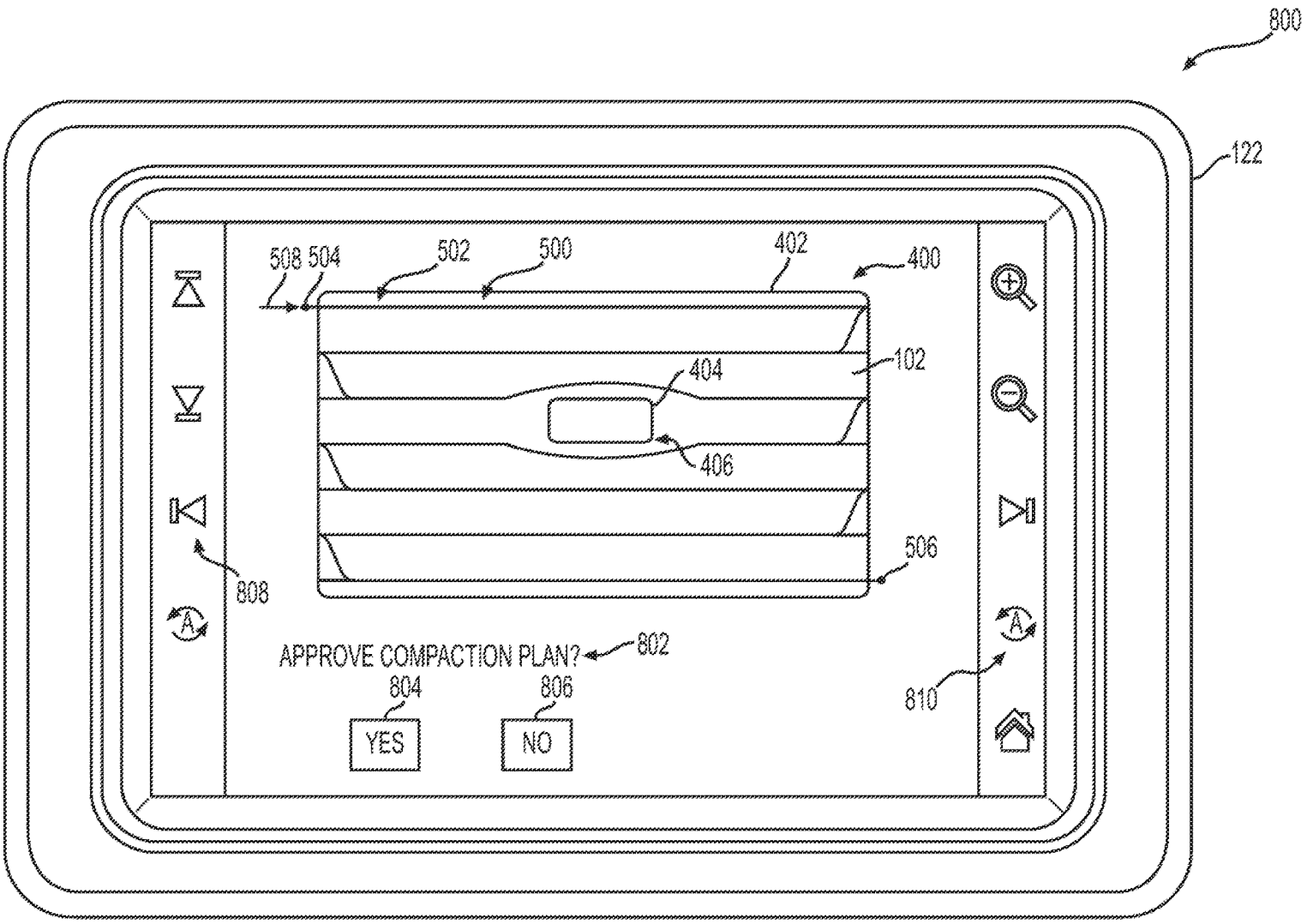
FIG. 8 is an example screenshot of a control interface displaying at least part of an example travel path according to an example embodiment of the present disclosure.

FIG. 8 illustrates an example screenshot of the control interface 122 associated with causing at least part of the travel path 502 and/or other components of the compaction plan 500 to be displayed at 310. As noted above, the control interface 122 may comprise an analog, digital, and/or touch-screen display, and such a control interface 122 may be configured to display a user interface 800 that includes at least part of the travel path 502 and/or other components of the compaction plan 500. The user interface 800 may also include, for example, labels, location names, GPS coordinates of the respective locations, and/or other information associated with the compaction plan 500, and/or with operation of the compaction machine 100. In any of the embodiments described herein, information provided by the user interface 800 may be displayed and/or updated in real-time to assist the operator in controlling operation of the compaction machine 100.

As shown in FIG. 8, in some examples at 310 the controller 130 may cause the control interface 122 to display one or more messages 802 intended for consumption by the operator of the compaction machine 100. For example, at 310 the controller 130 may cause the control interface 122 to display a message 802 requesting that the operator approve the travel path 502. In particular, the message 802 may request that the operator approve the travel path 502 displayed via the user interface 800, and/or that the operator approve various other portions of the compaction plan 500 provided via the control interface 122 at 310. The controller 130 may also cause the control interface 122 to display one or more buttons, icons, and/or other data fields 804, 806. Such data fields 804, 806 may comprise, for example, portions of the touch screen display, and/or other components of the control interface 122 configured to receive input (e.g., touch input) from the operator. It is understood that various other controls of the compaction machine 100 may also be used to receive such inputs. In still further examples, the control interface and/or other components of the compaction machine 100 may be configured to receive such inputs via voice recognition, gesture recognition, and/or other input methodologies. In various examples, the controller 130 may also cause the control interface 122 to display one or more additional buttons, icons, and/or other controls 808, 810 operable to control various respective functions of the compaction machine 100 and/or of the control interface 122.

In some examples, the operator may provide an input via the data field 806, indicating that the operator does not approve the travel path 502. In such examples, at 312—No, control may proceed to 302, and at least part of the method 300 may be repeated. Additionally or alternatively, the controller 130 may enable the operator to modify the travel path 502 and/or one or more portions of the compaction plan 500, via the control interface 122, in response to receiving such an input at 312. In other examples, at 312—Yes the operator may provide an input via the data field 804 indicating that the operator does approve the travel path 502. In such examples, at 312, the controller 130 may receive the input indicative of approval of the travel path 502 based at least partly on the at least part of the travel path 502 being displayed via the control interface 122.

Figure 9:
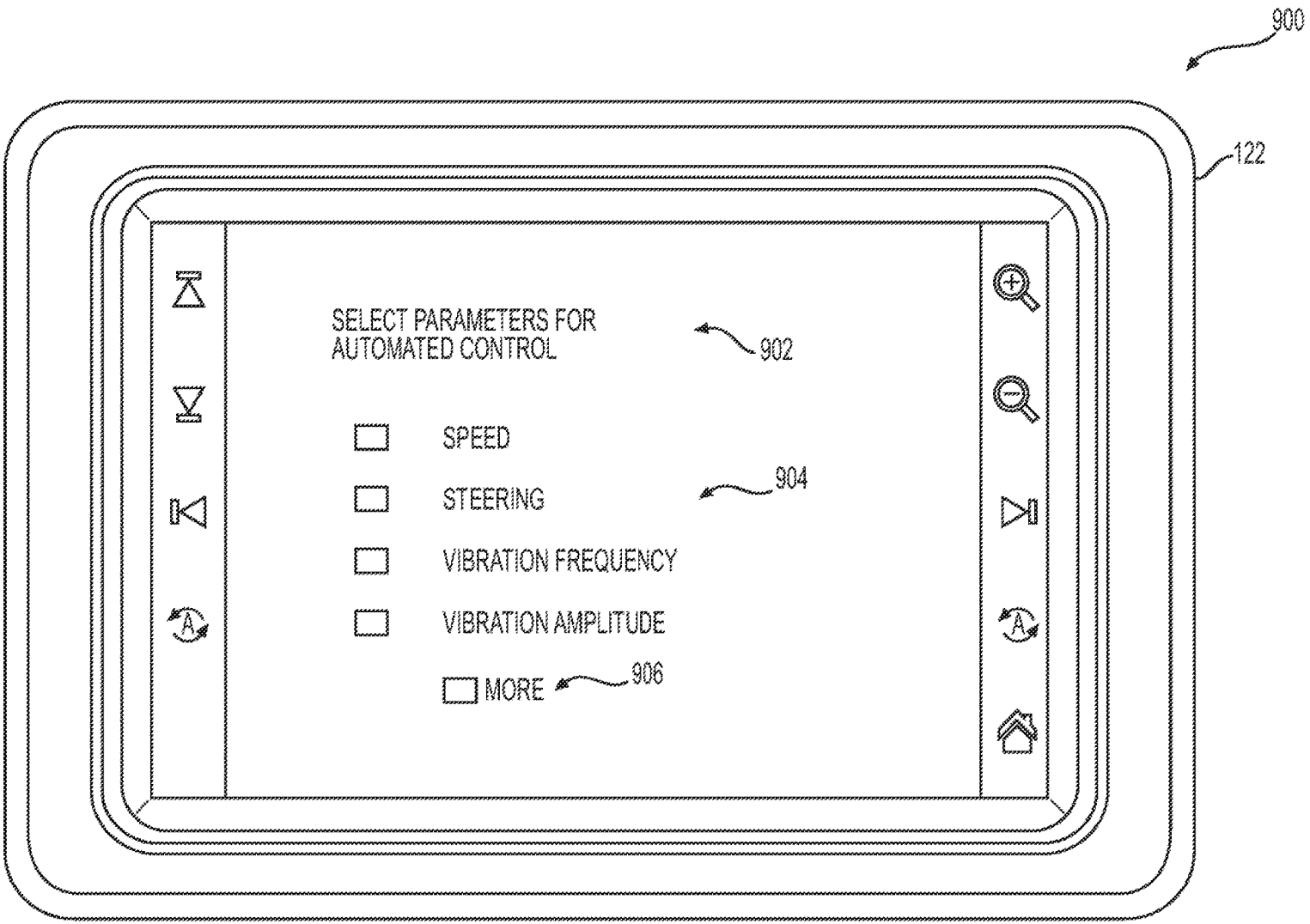
FIG. 9 is an example screenshot of a control interface displaying a message according to an example embodiment of the present disclosure.

At 314, the controller 130 may control operation of at least one component of the compaction machine 100 on the worksite surface 102, in accordance with the construction plan 500, based at least partly on receiving the input indicative of approval of the travel path 502 at 312—Yes. For example, at 314 the controller 130 may, based at least partly on receiving the input indicative of approval of the travel path 502, cause the control interface 122 to display one or more additional messages for consumption by an operator of the compaction machine 100. FIG. 9 illustrates a screenshot of an example user interface 900 including such an additional message 902. In such examples, the message 902 may comprise a request for the operator to select one or more operating parameters (e.g., speed, steering, vibration frequency of the first drum 106 and/or the second drum 108, vibration amplitude of the first drum 106 and/or the second drum 108, etc.) of the compaction machine 100 that may be automatically controlled by the controller 130 during a compaction operation in accordance with the compaction plan 500.

At 314, and based at least partly on receiving the input indicative of approval of the travel path 502, the controller 130 may also cause the control interface 122 to display one or more buttons, icons, and/or other data fields 904, 906. Such data fields 904, 906 may comprise, for example, portions of the touch screen display, and/or other components of the control interface 122 configured to receive input (e.g., touch input) from the operator. Such data fields 904 may, for example, enable the operator to provide an input (e.g., touch input) via the control interface 122 in order to select one or more of the parameters noted above. For example, in response to receiving an input via one of the data fields 904, the controller 130 may, at 314, control the compaction machine 100 to traverse the travel path 502 without at least one of steering input from an operator of the compaction machine 100, or speed input from the operator. Additionally or alternatively, in response to receiving an input via one of the data fields 904, the controller 130 may, at 314, control at least one of a vibration frequency of the first drum 106 and/or the second drum 108, and a vibration amplitude of the first drum 106 and/or the second drum 108 as the compaction machine 100 traverses the travel path 502. The data field 906 may, for example, enable the operator to select one or more additional parameters for automatic control during a compaction operation, and/or may enable the operator to select one or more additional options.

In some examples, and at least partly in response to receiving an input via a data field 904 corresponding to vibration frequency and/or vibration amplitude, operation of the first vibratory mechanism 110 and/or of the second vibratory mechanism 112 may be automatically controlled, in real-time, by the controller 130 as the compaction machine 100 traverses the travel path 502. For example, at 314 the controller 130 may receive one or more signals from the sensor 114 and/or from the sensor 116 as the compaction machine 100 traverses the travel path 502. In such examples, such signals may contain information indicative of a stiffness, density, and/or compactability of at least a portion of the worksite surface 102 located along the travel path 502. The controller 130 may, substantially continuously and/or in real-time compare such information to corresponding stored density information, look-up tables, etc. Alternatively, the controller 130 may use such information as inputs into one or more algorithms, equations, or other components to determine respective vibration frequencies, amplitudes, and/or other operating parameters required to satisfy the compaction requirements associated with the information received at 304. Thus, at 314 the controller 130 may modify operation of first vibratory mechanism 110 and/or of the second vibratory mechanism 112, in real-time, as the compaction machine 100 traverses the travel path 502 based at least partly on such determined vibration frequencies, amplitudes, and/or other operating parameters.

Figure 10:
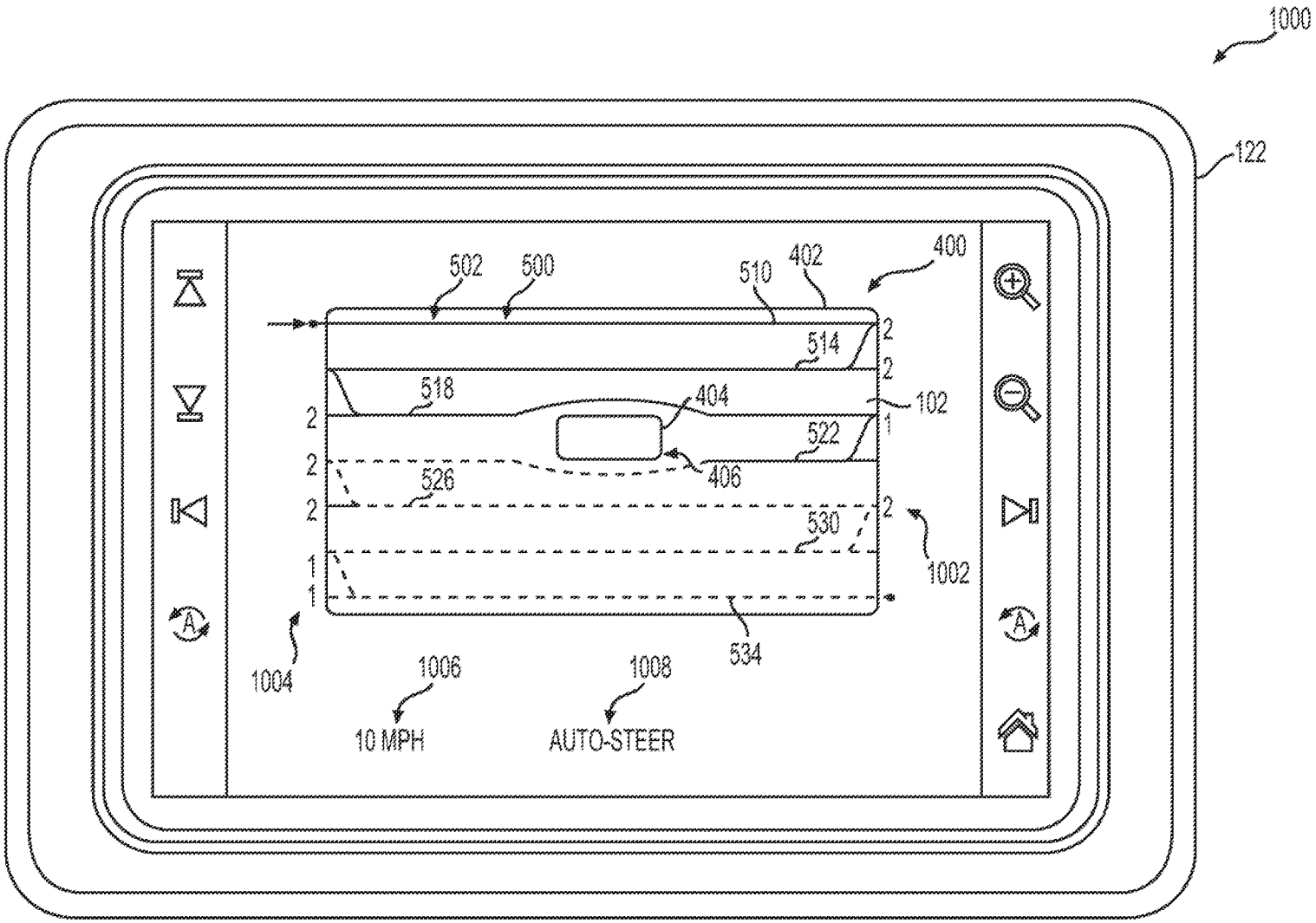
FIG. 10 is an example screenshot of a control interface displaying at least part of an example travel path according to yet another example embodiment of the present disclosure.

As shown in FIG. 10, in some examples at 314 and based at least partly on receiving the input indicative of approval of the travel path 502, the controller 130 may cause the control interface 122 to display a user interface 1000 that includes substantially the entire travel path 502 in real-time. For example, such a user interface 1000 may include a visual representation of the compaction plan 500, and the user interface 1000 may be displayed as the compaction machine 500 is controlled, either manually by the operator, semi-autonomously, or fully autonomously by the controller 130, to traverse the travel path 502. Such a user interface 1000 may display, for example, the travel path 502 simultaneously with and/or overlayed over at least part of an image of the worksite surface 102, or the worksite 400. In some examples, the user interface 1000 may use different visual indicia to illustrate various portions of the travel path 502 and/or portions of the compaction plan 500. For example, the user interface 1000 may display a first part of the travel path 502 (e.g., a part of the travel path 502 that has already been traversed by the compaction machine 100) in a first manner (e.g., using solid lines). In such examples, the user interface 1000 may display a second part of the travel path 502 (e.g., a part of the travel path 502 that has not yet been traversed by the compaction machine 100) in a second manner (e.g., using dotted lines) different from the first. Such a user interface 1000 may be substantially continuously updated, in real-time, to represent ongoing compaction activities by the compaction machine 100. In any of the example embodiments described herein, such an example user interface 1000 may assist the operator in manually controlling the steering, speed, and/or other operating parameters of the compaction machine 100 during a compaction operation and in accordance with the compaction plan 500.

For example, the user interface 1000 may include one or more numbers, images, icons, or other indicators 1002, 1004 indicating the number of times the compaction machine 100 has traversed the respective passes 510, 514, 518, 522, 526, 530, 534 of the illustrated travel path 502. For example, in the user interface 1000 shown in FIG. 10, the indicators 1002 indicate that the compaction machine 100 has traversed the passes 510 and 514 twice. Further, the partial dotted line illustrating the pass 522 may indicate that the compaction machine 100 is currently traversing the pass 522. Additionally, the indicators 1004 indicate that the compaction machine 100 has traversed passes 530 and 534 once.

In some examples, the user interface 1000 may also include one or more additional messages, text, icons, graphics, or other visual indicia 1006, 1008 indicating various respective operating parameters of the compaction machine 100 in real-time. For example, in the user interface 1000 illustrated in FIG. 10, the visual indicia 1006 indicates a real-time speed of the compaction machine 100, and the visual indicia 1008 indicates a current operating mode (e.g., automatic steering mode, autonomous control mode, semi-autonomous control mode, etc.) of the compaction machine 100. In further examples, such visual indicia 1006, 1008 may also indicate a vibration frequency of the first drum 106 and/or the second drum 108, a vibration amplitude of the first drum 106 and/or the second drum 108, an efficiency of the current compaction operation, a location (e.g., GPS coordinates) of the compaction machine, a stiffness, density, and/or other characteristic of the worksite surface 602, an estimated remaining time associated with the current compaction operation, an estimated total time associated with the compaction operation, a progress percentage and/or other indicator, an estimated maximum coverage, and/or other operating parameters of the compaction machine 100. In any such examples, the example user interface 1000 may assist the operator in manually controlling the steering, speed, and/or other operating parameters of the compaction machine 100 during a compaction operation and in accordance with the compaction plan 500. Again, in any of the examples described herein, the compaction machine 100 may travel in a forward direction and/or a reverse direction along any of the passes or turns of the travel path.

INDUSTRIAL APPLICABILITY

The present disclosure provides systems and methods for generating a compaction plan associated with a worksite surface. Such systems and methods may be used to achieve improved compaction consistency and efficiency at the worksite. As a result, paving materials that are later disposed on such compacted worksite surfaces may have greater longevity and may provide improved driving conditions. As noted above with respect to FIGS. 1-10, an example method 300 of generating a compaction plan may include receiving first information indicative of a location of a perimeter of the worksite surface to be compacted. Such a method 300 may also include receiving second information indicative of a desired stiffness, density, and/or other compaction requirements specific to the worksite surface. In some examples, such a method 300 may further include receiving additional information indicative of a location of a perimeter of one or more avoidance zones located substantially within the perimeter of the worksite surface to be compacted. As part of such a method 300, a controller 130 associated with a compaction machine 100 and/or disposed remotely from the compaction machine 100 may generate a compaction plan based at least partly on the information described above. Such a compaction plan may include a travel path for the compaction machine 100, and the travel path may be substantially within the perimeter of the worksite surface. The controller 130 may cause at least part of the travel path to be displayed via a control interface of the compaction machine 100. Further, based at least partly on receiving an input indicative of approval of the travel path, the controller 130 may control operation of one or more components of the compaction machine 100, on the worksite surface, in accordance with the compaction plan.

By causing at least part of the travel path to be displayed, an operator of the compaction machine 100 may review, confirm the accuracy of, and/or modify the travel path before beginning one or more compaction operations. The controller 130 may also be configured to provide the travel path and/or other components of the compaction plan to a mobile device 208 used by, for example, a foreman at the worksite and/or to a computing device 204 located at, for example, a remote paving material production plant. Providing such information in this way may also enable, for example, the foreman to review, confirm the accuracy of, and/or modify the travel path before compaction operations begin. Additionally, controlling the operation of the compaction machine 100 in accordance with the compaction plan may reduce over-compaction of the worksite surface, and may result in improved compaction consistency and efficiency.

Thus, the example systems and methods described above may provide considerable cost savings, and may reduce the time and labor required for various compaction operations at the worksite.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A method, comprising:

receiving first information indicative of a location of a perimeter of a worksite surface;

receiving second information indicative of compaction requirements specific to the worksite surface;

generating a compaction plan based at least partly on the first and second information, wherein generating the compaction plan includes determining a travel path for a compaction machine, the determined travel path being substantially within the perimeter of the worksite surface;

causing at least part of the determined travel path to be displayed via a control interface of the compaction machine;

receiving an input indicative of approval of the determined travel path; and controlling operation of the compaction machine on the worksite surface, in accordance with the compaction plan, based at least partly on receiving the input.

2. The method of claim 1, wherein the first information is received from a location sensor connected to the compaction machine, the location sensor determining the first information based at least partly on the compaction machine traversing the perimeter of the worksite surface.

3. The method of claim 1, further comprising receiving third information indicative of a location of a perimeter of an avoidance zone located substantially within the perimeter of the worksite surface, and generating the compaction plan based at least partly on the third information, the compaction machine being prohibited from entering the avoidance zone.

4. The method of claim 3, wherein the third information is received from a location sensor connected to the compaction machine, the location sensor determining the third information based at least partly on the compaction machine traversing the perimeter of the avoidance zone.

5. The method of claim 1, wherein the compaction requirements include at least one of a number of passes associated with the worksite surface and a density of the worksite surface.

6. The method of claim 1, wherein generating the compaction plan includes:

determining a first polygonal shape substantially matching a corresponding first portion of the worksite surface, and determining a second polygonal shape substantially matching a corresponding second portion of the worksite surface adjacent to the first portion of the worksite surface, the determined travel path including a first plurality of sequential passes substantially within the first portion of the worksite surface, and a second plurality of sequential passes substantially within the second portion of the worksite surface.

7. The method of claim 1, wherein controlling operation of the compaction machine includes causing the compaction machine to traverse the determined travel path without at least one of steering input from an operator of the compaction machine and speed input from the operator.

8. The method of claim 1, wherein controlling operation of the compaction machine includes controlling, as the compaction machine traverses the determined travel path, at least one of a vibration frequency of a drum connected to the compaction machine and a vibration amplitude of the drum.

9. The method of claim 1, wherein the determined travel path comprises a plurality of sequential passes across the worksite surface, and wherein generating the compaction plan includes determining, for a drum connected to the compaction machine, at least one of a vibration frequency and a vibration amplitude corresponding to each pass of the plurality of sequential passes.

10. The method of claim 9, further including receiving third information indicative of a density of a portion of the worksite surface located along the determined travel path, and modifying the at least one of the vibration frequency and the vibration amplitude, as the compaction machine traverses the determined travel path, based at least partly on the third information.

11. A control system, comprising:

a location sensor configured to determine a location of a compaction machine on a worksite surface;

a control interface connected to the compaction machine; and a controller in communication with the location sensor and the control interface, the controller configured to:

receive first information indicative of a location of a perimeter of the worksite surface, receive second information indicative of compaction requirements specific to the worksite surface, generate a compaction plan based at least partly on the first and second information, wherein generating the compaction plan includes determining a travel path for the compaction machine, the determined travel path being substantially within the perimeter of the worksite surface, and control operation of the compaction machine on the worksite surface, in accordance with the compaction plan, based at least partly on receiving an input indicative of approval of the determined travel path.

12. The control system of claim 11, wherein the controller is further configured to:

cause at least part of the determined travel path to be displayed via the control interface, and receive the input via the control interface.

13. The control system of claim 11, wherein the first information is received from one of the location sensor and memory having the first information stored thereon.

14. The control system of claim 11, wherein controlling operation of the compaction machine includes controlling, as the compaction machine traverses the determined travel path and without input from an operator of the compaction machine, a vibration frequency of a drum connected to the compaction machine, a vibration amplitude of the drum, steering of the compaction machine, and speed of the compaction machine.

15. The control system of claim 11, wherein the controller is in communication with at least one of a remote computing device and a mobile device via a network, the controller being configured to provide the compaction plan to the at least one of the computing device and the mobile device via the network.

16. A compaction machine, comprising:

a substantially cylindrical drum configured to compact a worksite surface as the compaction machine traverses the worksite surface;

a location sensor configured to determine a location of the compaction machine on the worksite surface;

a control interface; and a controller in communication with the location sensor and the control interface, the controller configured to:

receive first information from the location sensor indicative of a location of a perimeter of the worksite surface, receive second information indicative of compaction requirements specific to the worksite surface, generate a compaction plan based at least partly on the first and second information, wherein generating the compaction plan includes determining a travel path for the compaction machine, the determined travel path being substantially within the perimeter of the worksite surface, cause at least part of the determined travel path to be displayed via the control interface, and control operation of the compaction machine on the worksite surface, in accordance with the compaction plan, based at least partly on receiving an input indicative of approval of the determined travel path.

17. The compaction machine of claim 16, wherein generating the compaction plan includes determining at least one of a vibration frequency of the drum and a vibration amplitude of the drum.

18. The compaction machine of claim 17, wherein the controller is configured to:

receive third information indicative of a density of a portion of the worksite surface located along the determined travel path, and modify the at least one of the vibration frequency and the vibration amplitude, as the compaction machine traverses the determined travel path, based at least partly on the third information.

19. The compaction machine of claim 16, wherein the controller is configured to:

receive third information from the location sensor indicative of a perimeter of an avoidance zone located substantially within the perimeter of the worksite surface, and prohibit the compaction machine from entering the avoidance zone.

20. The compaction machine of claim 16, wherein generating the compaction plan includes:

determining a first polygonal shape substantially matching a corresponding first portion of the worksite surface, and determining a second polygonal shape substantially matching a corresponding second portion of the worksite surface adjacent to the first portion of the worksite surface, the determined travel path including a first plurality of sequential passes substantially within the first portion of the worksite surface, and a second plurality of sequential passes substantially within the second portion of the worksite surface.

* * * * *